US009552699B2

(12) United States Patent
Pececnik et al.

(10) Patent No.: US 9,552,699 B2
(45) Date of Patent: Jan. 24, 2017

(54) ELECTRONIC DICE GAMES AND SIC BO VARIANT

(71) Applicants: Joze Pececnik, Smarca (SI); Jamie Abrahamson, Las Vegas, NV (US)

(72) Inventors: Joze Pececnik, Smarca (SI); Jamie Abrahamson, Las Vegas, NV (US)

( * ) Notice: Subject to any disclaimer, the term of this patent is extended or adjusted under 35 U.S.C. 154(b) by 333 days.

(21) Appl. No.: 13/707,586

(22) Filed: Dec. 6, 2012

(65) Prior Publication Data

US 2014/0162758 A1 Jun. 12, 2014

(51) Int. Cl.
*G07F 17/32* (2006.01)

(52) U.S. Cl.
CPC ..... *G07F 17/3288* (2013.01); *G07F 17/3262* (2013.01)

(58) Field of Classification Search
CPC ..... G07F 17/3288
USPC ..... 463/16
See application file for complete search history.

(56) References Cited

U.S. PATENT DOCUMENTS

| | | | | |
|---|---|---|---|---|
| 5,413,351 | A | 5/1995 | Franklin | |
| 5,788,574 | A * | 8/1998 | Ornstein et al. | 463/25 |
| 7,309,065 | B2 * | 12/2007 | Yoseloff et al. | 273/292 |
| 7,351,145 | B1 * | 4/2008 | Ornstein et al. | 463/25 |
| 2002/0006820 | A1 * | 1/2002 | Romero | 463/12 |
| 2004/0116179 | A1 * | 6/2004 | Nicely et al. | 463/25 |
| 2006/0049578 | A1 | 3/2006 | Chen et al. | |
| 2006/0202416 | A1 | 9/2006 | Madden et al. | |
| 2006/0249907 | A1 | 11/2006 | Wong et al. | |
| 2007/0135204 | A1 * | 6/2007 | Nicely | 463/17 |
| 2007/0293308 | A1 * | 12/2007 | Jackson et al. | 463/25 |
| 2008/0061505 | A1 * | 3/2008 | Snow | 273/274 |
| 2008/0146344 | A1 * | 6/2008 | Rowe et al. | 463/42 |
| 2009/0325686 | A1 * | 12/2009 | Davis et al. | 463/25 |
| 2010/0069142 | A1 | 3/2010 | Kido | |
| 2012/0153571 | A1 * | 6/2012 | Smith et al. | 273/274 |
| 2012/0289300 | A1 * | 11/2012 | Chun | 463/13 |
| 2012/0302307 | A1 * | 11/2012 | Abrahamson | 463/17 |
| 2012/0322529 | A1 * | 12/2012 | Gilbertson | 463/17 |
| 2013/0005426 | A1 * | 1/2013 | Nicely | 463/20 |
| 2013/0225254 | A1 * | 8/2013 | Pececnik et al. | 463/17 |

FOREIGN PATENT DOCUMENTS

| | | | | |
|---|---|---|---|---|
| WO | WO 2008148147 | A1 * | 12/2008 | G07F 17/34 |

* cited by examiner

*Primary Examiner* — Jason Skaarup
(74) *Attorney, Agent, or Firm* — Mark A. Litman & Associates, P.A.

(57) ABSTRACT

A method and apparatus provide a side bet game play method for dice games and particularly Sic Bo. Multiple outcomes may be wagered on for occurrence of Trips. Excess numbers of dice beyond what are needed for a dice game outcome are reduced to the necessary number for use in the dice game by visual identification selection or exclusion by input or automatic processor selection/exclusion.

16 Claims, 13 Drawing Sheets

ELECTRONIC DICE GAMES AND SIC BO VARIANT

BACKGROUND OF THE INVENTION

1. Field of the Invention

The present invention relates to the field of electronic driven dice games, to variations of wagers for Sic Bo and provision of electronic variations in random selection of dice used in gaming outcomes.

2. Background of the Art

Sic Bo, meaning "dice pair" is an ancient Chinese gambling game. It is very popular in Macau, in my estimation second to baccarat only. In the United States is often found in the Asian gaming rooms, especially in Atlantic City. The large Las Vegas properties will usually have one table in the general casino.

The game uses three dice and a table with a variety of betting options on the roll of those dice. The odds and table layout may also vary from place to place. However, the payoffs are the same across Atlantic City and Macau, but different from each other. In Vegas and on the Internet casinos, anything is possible.

Following is a list of the bets available. The payoffs vary on some bets, from casino to casino, so for those bets a range of viable payoffs is indicated.

Small: Wins on total of 4-10, except for a three of a kind. Probability of winning is 48.61%. Pays 1 to 1. House edge is 2.78%.

Big: Wins on total of 11-17, except for a three of a kind. Probability of winning is 48.61%. Pays 1 to 1. House edge is 2.78%.

Total of 4 and 17: Pays 50 to 1 in Macau, 60 to 1 in Atlantic City, and 62 to 1 in Australia.

House Edge for 4 and 17 Bets

| Pays | Probability | Return |
|---|---|---|
| 50 | 1.39% | 29.17% |
| 51 | 1.39% | 27.78% |
| 52 | 1.39% | 26.39% |
| 53 | 1.39% | 25.00% |
| 54 | 1.39% | 23.61% |
| 55 | 1.39% | 22.22% |
| 56 | 1.39% | 20.83% |
| 57 | 1.39% | 19.44% |
| 58 | 1.39% | 18.06% |
| 59 | 1.39% | 16.67% |
| 60 | 1.39% | 15.28% |
| 61 | 1.39% | 13.89% |
| 62 | 1.39% | 12.5% |
| 63 | 1.39% | 11.11% |
| 64 | 1.39% | 9.72% |
| 65 | 1.39% | 8.33% |

Total of 5 and 16: Pays 18 to 1 in Macau, 30 to 1 in Atlantic City, and 31 to 1 in Australia.

House Edge for 5 and 16 Bets

| Pays | Probability | Return |
|---|---|---|
| 18 | 2.78% | 47.22% |
| 19 | 2.78% | 44.44% |
| 20 | 2.78% | 41.67% |
| 21 | 2.78% | 38.89% |
| 22 | 2.78% | 36.11% |
| 23 | 2.78% | 33.33% |

-continued

House Edge for 5 and 16 Bets

| Pays | Probability | Return |
|---|---|---|
| 24 | 2.78% | 30.56% |
| 25 | 2.78% | 27.78% |
| 26 | 2.78% | 25.00% |
| 27 | 2.78% | 22.22% |
| 28 | 2.78% | 19.44% |
| 29 | 2.78% | 16.67% |
| 30 | 2.78% | 13.89% |
| 31 | 2.78% | 11.11% |
| 32 | 2.78% | 8.33% |

Total of 6 and 15: Pays 14 to 1 in Macau, 17 to 1 in Atlantic City, and 18 to 1 in Australia.

House Edge for 6 and 15 Bets

| Pays | Probability | Return |
|---|---|---|
| 14 | 4.63% | 30.56% |
| 15 | 4.63% | 25.93% |
| 16 | 4.63% | 21.3% |
| 17 | 4.63% | 16.67% |
| 18 | 4.63% | 12.04% |
| 19 | 4.63% | 7.41% |

Total of 7 and 14: Pays 12 to 1 everywhere.

House Edge for 7 and 14 Bets

| Pays | Probability | Return |
|---|---|---|
| 10 | 6.94% | 23.61% |
| 11 | 6.94% | 16.67% |
| 12 | 6.94% | 9.72% |

Total of 8 and 13: Pays 8 to 1 everywhere.

House Edge for 8 and 13 Bets

| Pays | Probability | Return |
|---|---|---|
| 7 | 9.72% | 22.22% |
| 8 | 9.72% | 12.50% |

Total of 9 and 12: Pays 6 to 1 in Macau and Atlantic City. Pays 7 to 1 in Australia.

House Edge for 9 and 12 Bets

| Pays | Probability | Return |
|---|---|---|
| 6 | 11.57% | 18.98% |
| 7 | 11.57% | 7.41% |

Total of 10 and 11: Pays 6 to 1 everywhere. House edge of 12.50%.

Double: Bet on any specific pair (for example two 1's). Player wins if at least 2 of the number chosen appears. Pays 8 to 1 in Macau, 10 to 1 in Atlantic City, and 11 to 1 in Australia.

| House Edge for Double Bets | | |
|---|---|---|
| Pays | Probability | Return |
| 8 | 7.41% | 33.33% |
| 9 | 7.41% | 25.93% |
| 10 | 7.41% | 18.52% |
| 11 | 7.41% | 11.11% |

Triple: Player may bet on any specific trips (for example three 1's). Player wins if all 3 dice match the number chosen. Pays 150 to 1 in Macau and 180 to 1 in Atlantic City.

| House Edge for Triple Bets | | |
|---|---|---|
| Pays | Probability | Return |
| 150 | 0.46% | 30.09% |
| 155 | 0.46% | 27.78% |
| 160 | 0.46% | 25.46% |
| 165 | 0.46% | 23.15% |
| 170 | 0.46% | 20.83% |
| 175 | 0.46% | 18.52% |
| 180 | 0.46% | 16.20% |
| 185 | 0.46% | 13.89% |
| 190 | 0.46% | 11.57% |

Any Triple: Wins on any three of a kind. Pays 24 to 1 in Macau and 30 to 1 in Atlantic City.

| House Edge for Any Triple Bet | | |
|---|---|---|
| Pays | Probability | Return |
| 24 | 2.78% | 30.56% |
| 25 | 2.78% | 27.78% |
| 26 | 2.78% | 25.00% |
| 27 | 2.78% | 22.22% |
| 28 | 2.78% | 19.44% |
| 29 | 2.78% | 16.67% |
| 30 | 2.78% | 13.89% |
| 31 | 2.78% | 11.11% |
| 32 | 2.78% | 8.33% |

Any One Number: Bet on any specific number from 1 to 6. If chosen number appears 1 time bet pays 1 to 1, if it appears 2 times bet pays 2 to 1, and if it appears 3 times it pays 3 to 1 (in Atlantic City and Macau). Probability of 1 match is 34.72%, 2 matches is 6.94%, 3 matches is 0.46%. House edge of 7.87% (in Atlantic City and Macau). In Australia three matches pays 12 to 1, for a house edge of 3.70%.

Odd: Wins on any odd total, except loses with any three of a kind. The probability of winning is 48.61% and house edge is 2.78%.

Even: Wins on any even total, except loses with any three of a kind. This bet is predominantly in Macau, not in the United States. Probability of winning is 48.61% and house edge is 2.78%.

xyz: The player chooses a three-number combination, using three unique numbers, for example 1-3-5. The bet pays 30 to 1 if all three are rolled. Probability of winning is 2.78% and house edge is 13.89%.

xxy: The player chooses a three-number combination, using two unique numbers, and specifying which will be rolled twice. For example 2-2-4. The bet pays 50 to 1 if the roll matches exactly. So, in this example, 2-4-4 and 2-4-5 would lose. Probability of winning is 1.39% and house edge is 29.17%.

wxyz: The player chooses a four-number combination, using four unique numbers, for example 1-3-4-6. The bet pays 7 to 1 if the roll matches three of the chosen numbers. In my example, 1-3-4, 1-3-6, 1-4-6, and 3-4-6 would be the only winners. Probability of winning is 11.11% and house edge is also 11.11%.

xy: The player chooses a two-number combination, using two unique numbers. For example 2-5. The bet pays 5 to 1 if the roll contains both numbers. For example a bet on 2-5 would win on a rolls of 1-2-5, 2-2-5, 2-3-5, 2-4-5, 2-5-5, and 2-5-6. Probability of winning is 13.89% and house edge is 16.67%.

Following are tables summarizing each bet under the Atlantic City and Macau rules.

| Sic Bo - Atlantic City Rules | | | | |
|---|---|---|---|---|
| Bet | Pays | Winning Combinations | Probability | Return |
| Small, Big | 1 | 105 | 0.486111 | −0.027778 |
| 4, 17 | 60 | 3 | 0.013889 | −0.152778 |
| 5, 16 | 30 | 6 | 0.027778 | −0.138889 |
| 6, 15 | 17 | 10 | 0.046296 | −0.166667 |
| 7, 14 | 12 | 15 | 0.069444 | −0.097222 |
| 8, 13 | 8 | 21 | 0.097222 | −0.125 |
| 9, 12 | 6 | 25 | 0.115741 | −0.189815 |
| 10, 11 | 6 | 27 | 0.125000 | −0.125000 |
| Triple | 180 | 1 | 0.004630 | −0.162037 |
| Any triple | 30 | 6 | 0.027778 | −0.138889 |
| Double | 10 | 16 | 0.074074 | −0.185185 |
| Xy | 5 | 30 | 0.138889 | −0.166667 |
| Any number | 1, 2, 3 | 75, 15, 1 | 0.421296 | −0.078704 |

Following is a table summarizing each bet under the Macau rules.

| Sic Bo - Macau Rules | | | | |
|---|---|---|---|---|
| Bet | Pays | Winning Combinations | Probability | Return |
| Small, Big | 1 | 105 | 0.486111 | −0.027778 |
| Odd, Even | 1 | 105 | 0.486111 | −0.027778 |
| 4, 17 | 50 | 3 | 0.013889 | −0.291667 |
| 5, 16 | 18 | 6 | 0.027778 | −0.472222 |
| 6, 15 | 14 | 10 | 0.046296 | −0.305556 |
| 7, 14 | 12 | 15 | 0.069444 | −0.097222 |
| 8, 13 | 8 | 21 | 0.097222 | −0.125000 |
| 9, 12 | 6 | 25 | 0.115741 | −0.189815 |
| 10, 11 | 6 | 27 | 0.125000 | −0.125000 |
| Triple | 150 | 1 | 0.004630 | −0.300926 |
| Any triple | 24 | 6 | 0.027778 | −0.305556 |
| Double | 8 | 16 | 0.074074 | −0.333333 |
| xyz | 30 | 6 | 0.027778 | −0.138889 |
| xxy | 50 | 3 | 0.013889 | −0.291667 |
| wxyz | 7 | 24 | 0.111111 | −0.111111 |
| xy | 5 | 30 | 0.138889 | −0.166667 |
| Any number | 1, 2, 3 | 75, 15, 1 | 0.421296 | −0.078704 |

Following is a table summarizing each bet under the Australia rules.

| Sic Bo - Australia Rules | | | | |
|---|---|---|---|---|
| Bet | Pays | Winning Combinations | Probability | Return |
| Small, Big | 1 | 105 | 0.486111 | −0.027778 |
| 4, 17 | 62 | 3 | 0.013889 | −0.125000 |
| 5, 16 | 31 | 6 | 0.027778 | −0.111111 |
| 6, 15 | 18 | 10 | 0.046296 | −0.120370 |

-continued

| | | | | |
|---|---|---|---|---|
| 7, 14 | 12 | 15 | 0.069444 | −0.097222 |
| 8, 13 | 8 | 21 | 0.097222 | −0.125000 |
| 9, 12 | 7 | 25 | 0.115741 | −0.074074 |
| 10, 11 | 6 | 27 | 0.125000 | −0.125000 |
| Triple | 180 | 1 | 0.004630 | −0.162037 |
| Any triple | 31 | 6 | 0.027778 | −0.111111 |
| Double | 11 | 16 | 0.074074 | −0.111111 |
| xy | 6 | 30 | 0.138889 | −0.027778 |
| Any number | 1, 2, 12 | 75, 15, 1 | 0.421296 | −0.037037 |

Sic Bo House Edge Comparison

| Bet | Macau | Atlantic City | Australia |
|---|---|---|---|
| Small, Big | 2.78% | 2.78% | 2.78% |
| 4, 17 | 29.17% | 15.28% | 12.50% |
| 5, 16 | 47.22% | 13.89% | 11.11% |
| 6, 15 | 30.56% | 16.67% | 12.04% |
| 7, 14 | 9.72% | 9.72% | 9.72% |
| 8, 13 | 12.50% | 12.50% | 12.50% |
| 9, 12 | 18.98% | 18.98% | 7.41% |
| 10, 11 | 12.5% | 12.50% | 12.50% |
| Triple | 30.09% | 16.20% | 16.20% |
| Any triple | 30.56% | 13.89% | 11.11% |
| Double | 33.33% | 18.52% | 11.11% |
| xy | 16.67% | 16.67% | 2.78% |
| Any number | 7.87% | 7.87% | 3.7% |

Yee Hah Hi

About 20% of the many Sic Bo tables in Macau use dice with pictures, instead of numbers. The name of this game is "Yee Hah Hi." The translation is "Fish Shrimp Crab." Each picture has an associated number, as shown below. In addition to the usual bets there are some based on the colors of the symbols, as explained below.

Sic Bo - Chinese Dice Rules

| Symbol | Color | Number |
|---|---|---|
| Fish | Red | 1 |
| Scorpion | Green | 2 |
| Goard | Blue | 3 |
| Coin | Blue | 4 |
| Crab | Green | 5 |
| Rooster | Red | 6 |

All same color: Wins if all three dice are the same color. Pays 7 to 1. The probability of winning and house edge are both, coincidentally, 11.11%.

Exactly two of specific color: Wins if exactly two dice are a color chose by the player, for example red. Pays 3 to 1. The probability of winning is 22.22%, and house edge is 11.11%.

Exactly one of specific color: Wins if exactly one die is a color chose by the player, for example red. Pays 1 to 1. The probability of winning is 44.44%, and house edge is 11.11%.

Underlying Rules of Sic Bo

Setup

Sic Bo is a dice game which consists of many places on the table to place bets. Three dice are used to determine the outcome of the betting.

Betting

The bottom row of the Sic Bo table has six betting areas. These are called single number bets. If one of the three dice comes up as one the numbers bet on (from 1-6), you get paid out at 1 to 1. If two numbers come up you get paid out at 2 to 1 and if three numbers come up you get paid out at 3 to 1. So if you bet on the number 3 and you wagered $5.00 and 2 threes came up you would win $10.00.

The two number combination bets consist of placing a wager on any 2 dice combinations. If you wager on a 6,4 combination and the result of the dice roll was 4,7,6, you would win at 6 to 1 odds. You can only win on one instance of the two-number combination.

A three number total wager consists of combining the total shown on the resulting dice roll. Different totals have different odds. A result of 3 or 18 is always a loss. The payouts are as follows:

4 or 17, 50 to 1;
5 or 16, 25 to 1;
6 or 15, 15 to 1;
7 or 14, 10 to 1;
8 or 13, 6 to 1;
9 or 12, 5 to 1;
10 or 11, 5 to 1.

You can wager on whether the combined total of the dice roll will be either between 4-10 or 11-17. This wager pays out at 1-1 odds. All small or big wagers lose if the result of the dice is a triplet.

Triplets or trips (Trips) are when the dice roll is all one number. So if you wagered on three 6's and that was the dice result you would win at 150-1 odds. You can also wager on all six triplet bets at once, this is called "Any Triplet" and pays out at 25-1 odds.

Pairs are when the resulting dice roll contains a pair of the same number. Whether you have two fives or three fives you still only win once and you win at odds of 11-1.

Sic Bo is a single roll dice game in which players may wager on the sum of the dice, typically three. For example, the player may wager on the sum of twelve without regard to the combination of the dice required to add up to twelve, i.e. the player would win if the dice show 6-5-1, or 5-5-2. Alternatively or additionally, the player may wager on the combination of the dice. In the before-mentioned example, the player might wager on the roll of the dice results to be 6-6-6. In Sic Bo, three dice are rolled and all wagers are immediately resolved; that is, there are, at present, no multiple roll wagers in Sic Bo. Sic Bo is an easy dice game to understand and play, however its simplicity fails to keep the player interested and large payouts can be limited.

Sic Bo, known to some people as Tai Sai, means dice pair in Chinese. It is an ancient Chinese game of chance. It may have originally used dice shaken between a plate and an overturned bowl, but today it commonly has three dice in a cage for tumbling. Extremely popular in Asian cultures, this exciting and engaging game is winning new converts in many casinos around the world. Sic Bo is easy to play. The object is to pick the numbers or combinations that will appear on the dice when they come to rest after tumbling. There are 50 different ways to place bets, so players have plenty of choices with a range of payouts—some as high as 180-to-1. In a sense, this game is somewhat similar to the Western game of craps, but it involves many more betting opportunities and combinations due to the use of one additional dice than the game of craps. However, despite this similarity, this game has not yet found its way into traditional Western-style casinos.

A dice game proposed in U.S. Pat. No. 5,413,351 as described above is performed according to special rules, however, there is a problem that people are not familiar with this game and its special rules and therefore this game lacks amusement. The Sic Bo generally widely known is familiar to people, so that it can amuse players, however, the BET patterns are limited, so that there is still room for upgrading in terms of improvement in amusement. In detail, in the BET region whose appearance frequency is low and award ratio is highest (approximately 1 to 180), it is considered that a player performs a BET operation in an excited state, however, in this BET region, it is only predicted that rolled numbers on three dice rolled are the same (the combination of rolled numbers on the dice is (1, 1, 1), (2, 2, 2) . . . (6, 6, 6)), and this area lacks excitement when making a BET.

Variations of Sic Bo are disclosed as Published US Patent Application Document No. 20060049578 (Chen) describes a game titled Let Me Roll Sic Bo as a dice game blending both Sic Bo with the traditional craps game. There are three regular dice (cubes). Each die has six sides and different number of spots on it (from one to six). Each player takes a turn to shoot the dice clockwise. Players can wager on nine main designed betting areas to win different odds.

Another variation of Sic Bo are disclosed as Published US Patent Application Document No. 20060202416 (Madden) describes a method of playing a betting dice game with a progressive payout is disclosed. The game includes three dice and a game table with up to four wager zones for players to place a bet on. The wager zones correspond to a sum of the dice. Payout to a winning player results from the wager placed on the wager zones and the corresponding first, second and third sequential rolls of the dice.

Published US Patent Application Document No. 20060249907 (Wong) describes an East-West casino game that offers two or more gambling games in which at least one game involves a Feng Shui element of chance and the other involves either a game based upon a new Chinese Poker Deck of cards or a video slot machine having a carousel in which two or more wheels rotate in opposite directions and a random event associated with the two or more wheels is used in connection with a payout or bonus round of the video slot machine. The game involving a Feng Shui element of chance can be a Yin-Yang roulette game or a video slot machine (which may at least partially based upon the Chinese Poker Deck) or a Feng Shui keno machine while a game based upon the Chinese Poker Deck may be a poker game and the casino itself may be a website. The video slot machine can use a carousel in which two or more wheels (which need not be round) rotate in opposite directions and additional wheel can be added in which symbols are shuffled. Examples of video slot machines include a Yin-Yang roulette game in which two balls travel in opposite directions (similar to a roulette wheel) with landings for the ball designated by symbols related to the Chinese games of Tin Gau, Mahjongg, Fan Tan or Sic Bo and a Feng Shui keno machine in which at least one Chinese character is broken down into a plurality of radicals.

Published US Patent Application Document No. 20100069142 (Kido) describes a dice gaming machine accepts a bet on a bet area and a bet on an intermediate area between/among a plurality of bet areas. After ending the bet acceptance, the gaming machine starts rolling dice. After the rolling of the dice has been stopped, the dice gaming machine identifies a winning bet area based on the dice rolling result. A payout amount for each terminal is calculated based on the identified winning bet area, the bet area or the intermediate area on which the bet is accepted, and a payout magnification ratio set for the bet area or the intermediate area.

Automatic Sic Bo Machines are known in the art wherein dice are automatically tossed and read, and wagers are electronically entered and resolved based on the automatic reading and tossing of dice. Combination systems where manually tossed dice, manually entered outcomes, and electronic wagers are used that are resolved based upon the manually entered (or electronically read) manually thrown dice outcomes. TCS John Huxley showcased a machine at 2007 G2E Asia in Macau. The ergonomically designed Super Sic Bo table featured a high definition 55 inch LCD playing screen with an apparent Sic Bo playing surface. High impact computer generated graphic animations highlighted 'no more bets' and all winning bets as well as indicating the streak bets of either odd or even and big or small numbers as they progress on the Super Streak side bet.

A voice announcement feature delivered game results and number sequences. This was available in multiple languages and gave players concise and distinctive game information and attracted new players to join in.

There was also offered a Super Streak side bet option offering players the opportunity to participate in a bonus bet determined by the results over a number of games, which are clearly displayed and easy to understand. This provides incremental payouts for a streak of either odd or even and big or small results. A triple result where the three dice all display the same number does not cancel the Super Streak.

The system was compatible with e-FX LCD displays and with Animator LED displays, showing the last 17 individual dice results, big or small betting options, odd or even betting options and Super Streak side bet streak progress are easy to see.

System Highlights Included
Jumbo size color dices (888 mm)
Integrated electronic dice shaker
Electronic dice outcome recognition
Digital dice results communication
Touch-screen bet placing
Fully automated game
SAS 6.02 enabled
Adaptive design and graphic presentation
Minimum and maximum bet limits
Wide range of betting options and payout odds
Automatic game results calculation and payout
Increased productivity—no game stops
Jackpots and side bets available
Betting time indication
Easier monitoring and accounting
Game information display
Electronically activated
Precise dice rolling
Elimination of "no spin" and incorrect dice throw
Special system for flat lying dices
Dice shaker failure detection
Glass dome-shaped shaker cover
Digital Dice recognition
Touch-screen betting
No human interference
Faster game playable 24/7 without personnel in attendance
Game and dice statistics An example image of an electronic system is shown in FIG. 1. All references cited herein are incorporated herein by reference.

SUMMARY OF THE INVENTION

A method and apparatus provide a side bet game play method for dice games and particularly Sic Bo. Multiple outcomes may be wagered on for occurrence of Trips. Excess numbers of dice beyond what are needed for a dice game outcome are reduced to the necessary number for use in the dice game by visual identification selection or exclusion by input or automatic processor selection/exclusion.

A side bet game specific for play with Sic Bo dice games is provided on electronic gaming systems. A variant on the underlying game is also available for use on electronic dice games. A side bet referred to as the "Lucky Trips" side bet can be easily added to any existing Sic Bo game. The player has the option to make the "Lucky Trips" side bet before each new game. Each side bet lasts for 2 rolls of the dice. Therefore, it is possible to have 2 games running at the same time (the upcoming roll of the dice is both the $1^{st}$ roll for a new side bet game, and the $2^{nd}$ and final roll for the previous side bet game). When making the side bet wager, the player is prompted to select his "lucky trips" (1 . . . 2 . . . 3 . . . 4 . . . 5 . . . 6). The side bet is then resolved after the following 2 rolls of the dice according to the pay table below.

More than three dice may be used in the game, with more than two colors (or other visually identifiable characteristics, such as art work, stripes, dot colors, face colors, etc.) on the more than three dice. For example, with four dice, there may be three or four color. The player or a processor may select (prior to dice outcome) the exact colors that constitute exactly a three dice outcome. Similarly, there may be five, six or more dice with the player or processor again selecting the exact colors that constitute an exactly three dice outcome.

DETAILED DESCRIPTION OF THE INVENTION

Figure 1A:
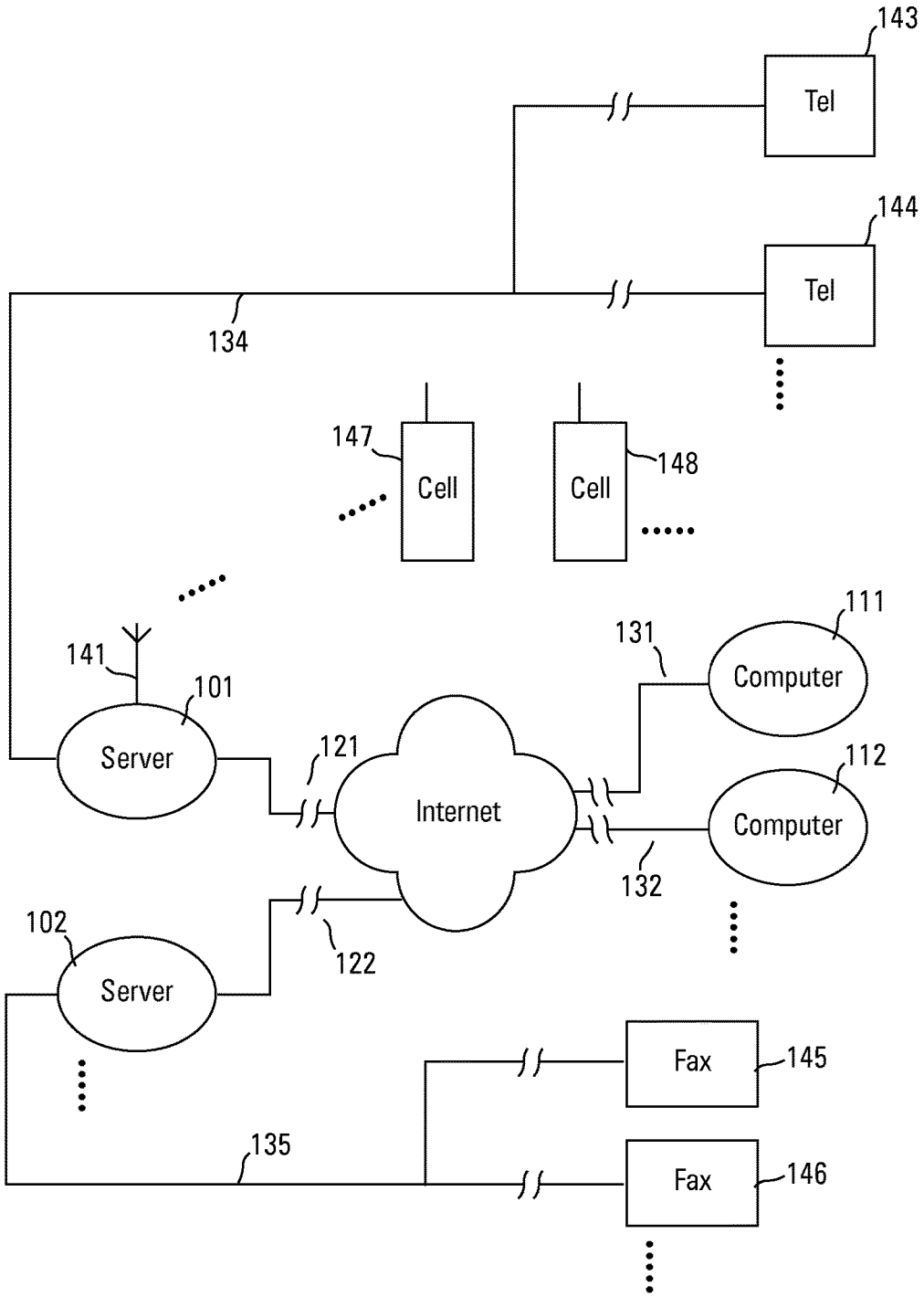
Fig. 1A Prior Art
FIG. 1 (PRIOR ART) shows a schematic for a Prior Art internet wagering system that may be used in combination with the present invention.
FIG. 1B (PRIOR ART) shows a Prior Art electromechanical Sic Bo gaming system that may be used to assist in performing the methods of the present invention with only additional software and/or additional dice added.
FIG. 1C (PRIOR ART) shows a perspective view of a prior art format for an automated gaming system.

The present invention includes a method of playing a wagering game on a gaming system that uses either a physical gaming table system, a blended physical gaming system and electronic wagering or an electronic gaming system using a processor, game logic, a video display and player input system. The method steps are primarily described for use with the electronic gaming system, but are parallel with the activities and rules used in the alternative structures. Those method steps include:

a) the processor accepting a first wager on a game of Sic Bo, the wager based upon virtual dice outcomes;
b) the first wager overlapping two consecutive random event outcomes comprising a first random event outcome and a second random event outcome;
c) the processor providing the first random outcome that comprises at least three individual die outcomes;
d) the processor displaying an image on the video display that includes a virtual image of the three individual die outcomes;
e) the processor determining that the random outcome includes three virtual dice each having a same die face outcome;
f) the processor resolving the first wager by awarding value monitored by the gaming system when the three virtual dice each has the same die face outcome; and
g) the processor maintaining active consideration of the first wager with respect to the random outcome of the second random event outcome.

Each of the at least three individual virtual dice may have six faces with different numerical values displayed on each face or with different art work displayed on each face. In a preferred game play method, the first wager carries over into a second random outcome when the processor has determined that the random outcome includes three virtual dice each having a same die outcome, and that the processor further resolves the first wager by awarding value monitored by the gaming system when the three virtual dice each has another same die outcome after the second random event. The first and/or second random event outcome is provided by an electronic random number generator.

The method may have the first wager resolution is made by the processor based upon a look-up table in which both the first random event outcome and the second random event outcome are considered in the resolution of the first wager:

| Event for 2 Random Event Outcomes | Ways | Probability | Payout versus First wager | Probability of the Payout on the First Wager |
|---|---|---|---|---|
| Two Identical Trips | 1 | 0.00002143 | 1000 | 0.021433 |
| Two Trips Outcome with a Specific Die Outcome Wagered | 10 | 0.00021433 | 500 | 0.107167 |
| Any 2 Trips Outcomes | 25 | 0.0053584 | 100 | 0.53584 |
| Specific Trip Outcome Wagered | 420 | 0.00900206 | 25 | 0.225051 |
| Any Trips | 2100 | 0.04501029 | 10 | 0.4501029 |
| No Trips | 44,100 | 0.94521605 | −1 | −0.94521605 |
| TOTAL | 46,656 | 1.00000000 | EDGE | 0.087877 |

The present technology includes a method of playing a wagering game on a gaming system that may include a processor, game logic, a video display and player input system. The method may have steps of:

a) the processor accepting a first wager on a game having a wager based upon virtual dice outcomes for at least two virtual dice;

b) the processor providing the first random outcome that comprises at least X individual virtual die outcomes providing greater than X individual virtual die outcomes wherein at least two of the individual virtual dice have visual characteristics that differentiate between the at least two individual virtual dice;

c) the processor displaying an image on the video display that includes a virtual image of greater than X individual virtual die outcomes, including the visual characteristics that differentiate between the at least two individual virtual dice;

d) the processor determining a random game event outcome for resolving by using only X virtual dice in determining the game event outcome where i) a specific selected visual characteristic of at least one of the at least two of the individual virtual dice which have visual characteristics that differentiate between the at least two individual virtual dice or ii) using only non-excluded specific visual characteristics of at least one of the at least two of the individual die which have visual characteristics that differentiate between the at least two individual dice;

e) the processor resolving the first wager by awarding value monitored by the gaming system when the X virtual dice provide a predetermined winning outcome according to the game logic; and f) the processor excluding consideration of all of the greater than X die that have either excluded visual characteristics or non-selected visual characteristics according to i) and ii).

The visual characteristic may be, by way of non-limiting examples, color of the virtual dice and the acceptance of the wager requires input identifying at least one color that is selected for determination of a winning game event outcome or at least one color that is excluded for determination of a winning game event outcome. Winning event outcomes may be determined according to outcomes for exactly two virtual dice and at least three virtual dice are displayed in game event outcomes on the video display system.

The winning event outcomes may be determined for Sic Bo and other dice games according to outcomes for exactly three virtual dice and at least four, five or six virtual dice are displayed in game event outcomes on the video display system. One benefit of this variant color selection adds to the game is that there is the potential for multiple wagers on Sic Bo and the side bet contemporaneously by enabling wager input to select different colors for different wagers. For example, where there are 2, 3, 4, 5 or 6 sets of dice, with multiple color selections available, players may make separate wagers on each color combinations. Where there are 18 dice, the color combinations available and color combinations available for wagers may be proportioned in many different ways. There may be, for example, six separate sets of 3-dice with single colors. There may be six sets of 2-dice with sets of color, plus six separate different dice of unique colors. In that latter manner, a set(s) of 2-dice color may be selected, and separate wagers made on each of the separate single unique color dice. Similarly, a single unique color 1-die may be selected and a set(s) of 2-dice combinations with the single die may be the object of wagers.

Another way of describing methods of playing a wagering game according to aspects of the present technology include:

a) the processor accepting the first wager on a game of Sic Bo, the wager based upon virtual dice outcomes for three virtual dice as the X dice;

b) the first wager overlapping two consecutive random event outcomes comprising a first random event outcome and a second random event outcome;

c) the processor providing the first random outcome that comprises greater than three individual die outcomes;

d) the processor displaying an image on the video display that includes a virtual image of the greater than three individual die outcomes;

e) the processor determining that the random outcome of selected or non-excluded three virtual dice outcomes includes three virtual dice each having a same die face outcome;

f) the processor resolving the first wager by awarding value monitored by the gaming system when the three virtual dice each has the same die face outcome; and g) the processor maintaining active consideration of the first wager with respect to the random outcome of the second random event outcome.

The method may use systems wherein each of the at least three individual virtual dice has six faces with different numerical values or different art work displayed on each face. In one variant of play, the first wager carries over into a second random outcome when the processor has determined that the random outcome includes three virtual dice each having a same die outcome, and that the processor further resolves the first wager by awarding value monitored by the gaming system when the three virtual dice each has another same die outcome after the second random event.

The first wager resolution is made by the processor based upon a look-up table in which both the first random event outcome and the second random event outcome are considered in the resolution of the first wager:

| Event for 2 Random Event Outcomes | Ways | Probability | Payout versus First wager | Probability of the Payout on the First Wager |
|---|---|---|---|---|
| Two Identical Trips | 1 | 0.00002143 | 1000 | 0.021433 |
| Two Trips Outcome with a Specific Die Outcome Wagered | 10 | 0.00021433 | 500 | 0.107167 |
| Any 2 Trips Outcomes | 25 | 0.0053584 | 100 | 0.53584 |
| Specific Trip Outcome Wagered | 420 | 0.00900206 | 25 | 0.225051 |
| Any Trips | 2100 | 0.04501029 | 10 | 0.4501029 |
| No Trips | 44,100 | 0.94521605 | −1 | −0.94521605 |
| TOTAL | 46,656 | 1.00000000 | EDGE | 0.087877 |

Figure 1B:
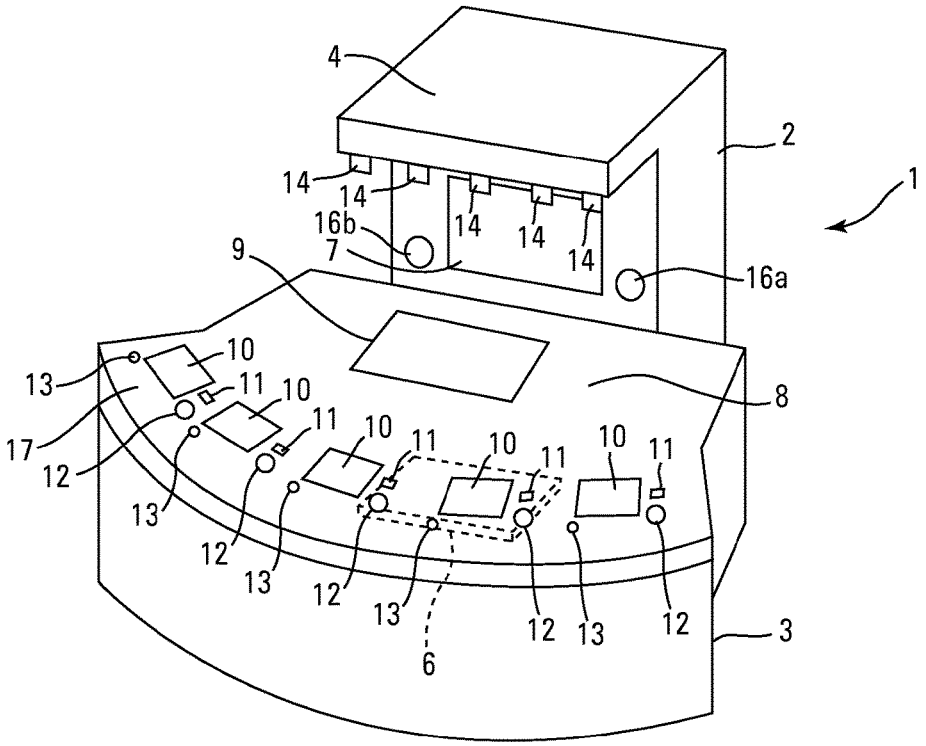
Fig. 1B Prior Art
Figure 1C:
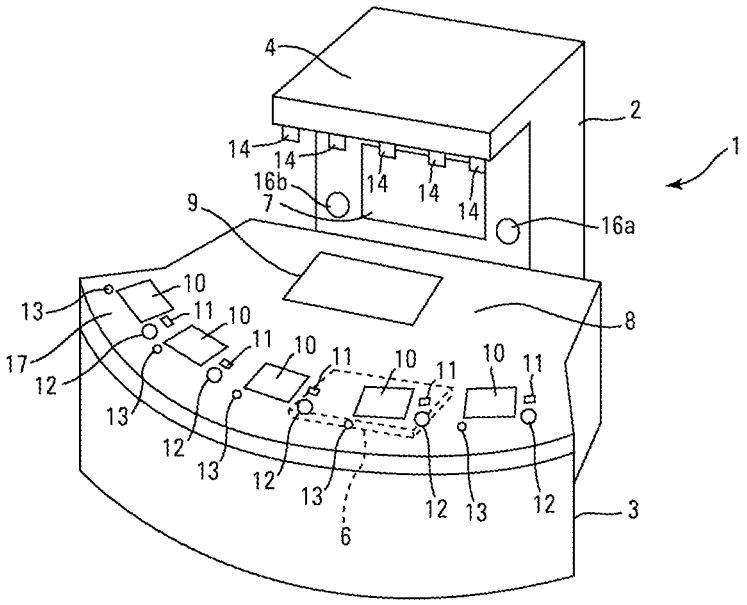
Fig. 1C Prior Art

FIG. 1C shows a fully automated gaming table 1 of the prior art, as disclosed in U.S. Patent Application 2003/0199316 and U.S. Pat. No. 7,628,689 which are incorporated herein by reference in their entirety. The system 1 comprises a vertical upright display cabinet 2 and a player bank or station cluster arrangement 3. The vertical display cabinet 2 has a top 4 and a viewing screen 7 on which images of the virtual dealer are displayed. The top 8 of the player bank arrangement 3 has individual monitor screens 10 for each player position, as well as tabletop inserted coin acceptors 11, and player controls 12 and 13. There is a separate and larger game play screen 9 on which dealer and player cards are displayed in a format large enough for all players to view. Additionally, wager areas and/or virtual chips representing wagers are also displayed in this area. Speakers 16*a* and 16*b* are provided for sound transmission and decorative lights 14 are provided. The processor 6 within the system 1 is shown.

Figure 2:
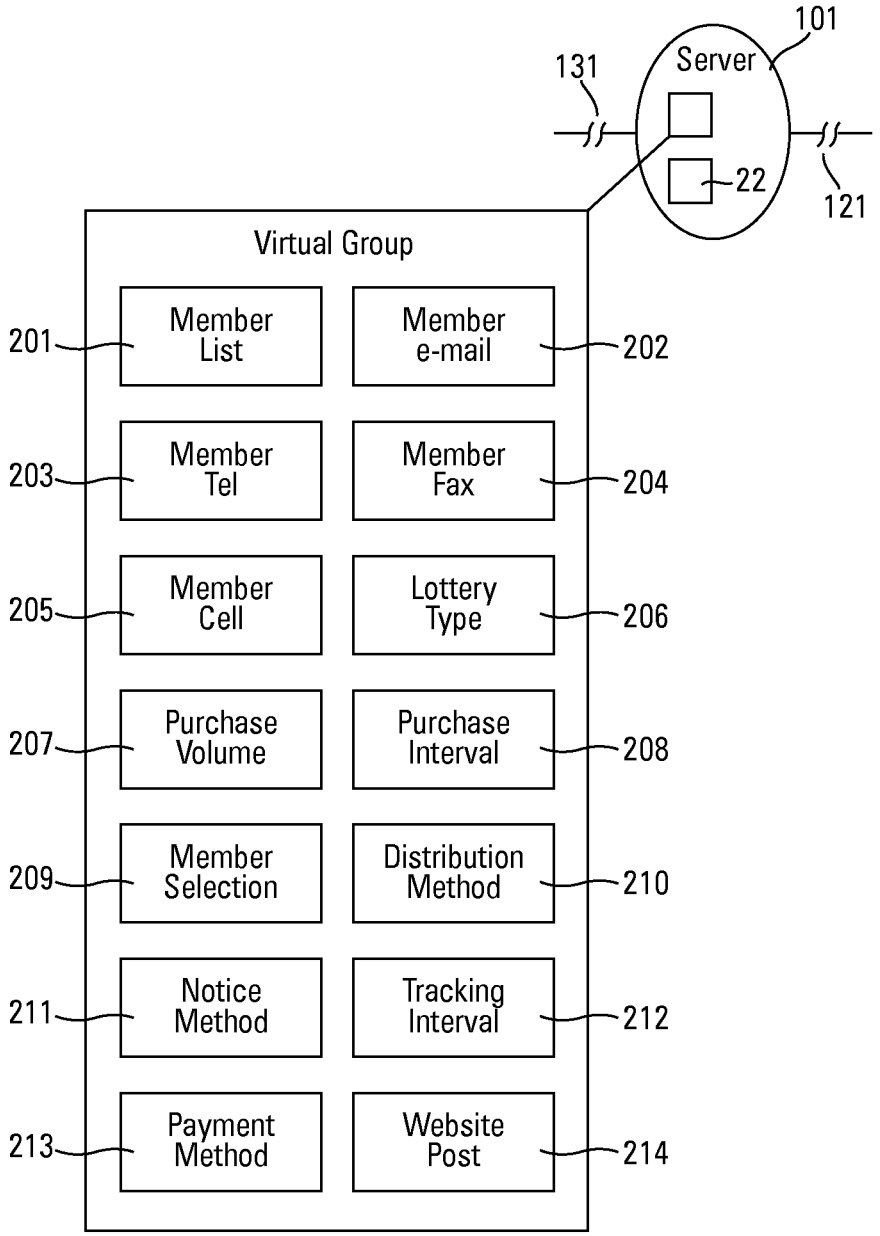
Fig. 2 Prior Art
FIG. 2 (PRIOR ART) shows a schematic for a Prior Art internet wagering system that may be used in combination with the present invention.
Figure 3:
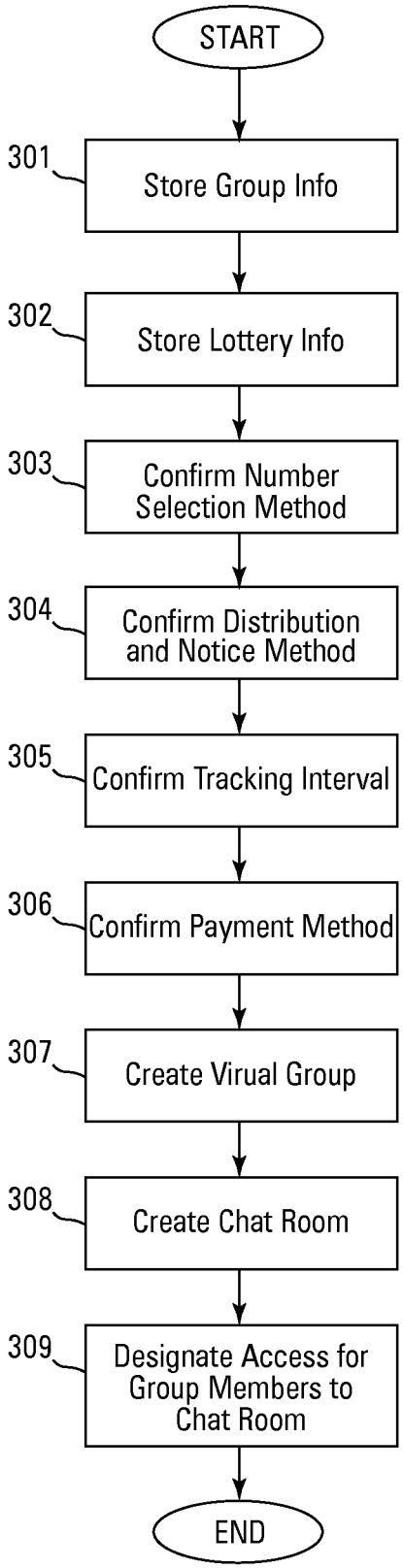
Fig. 3 Prior Art
FIG. 3 (PRIOR ART) shows a schematic for a Prior Art internet wagering system that may be used in combination with the present invention.
Figure 3A:
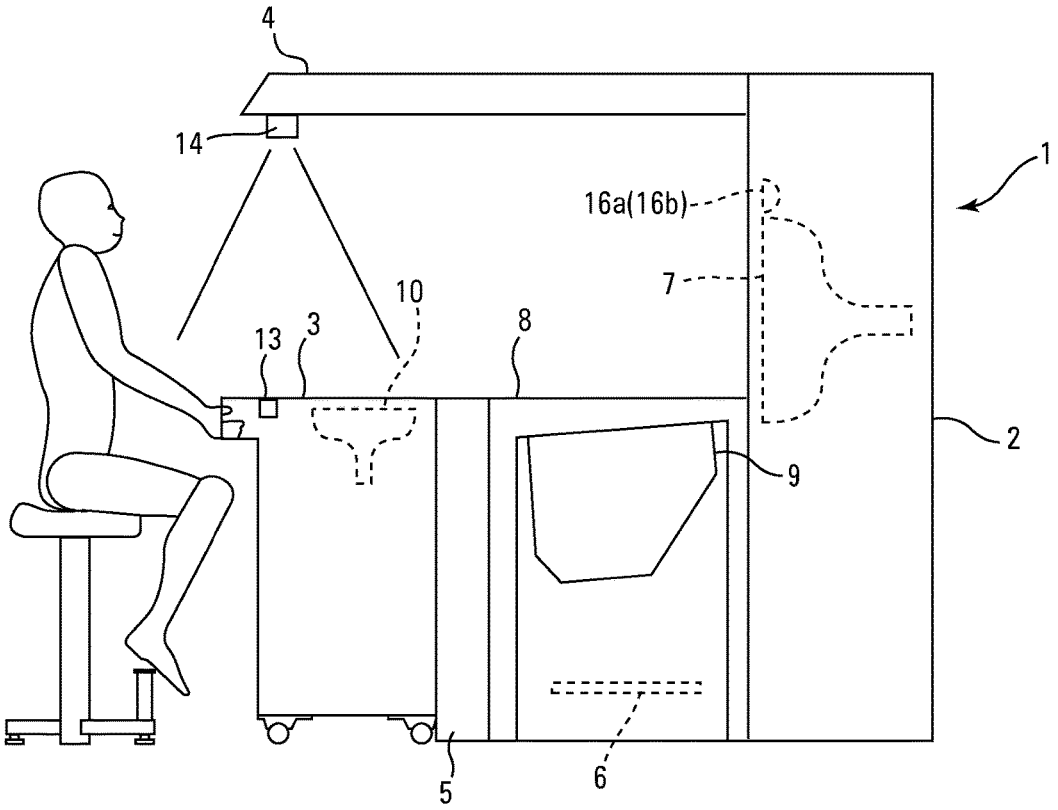
Fig. 3A Prior Art
FIG. 3A (PRIOR ART) shows a side elevational view of a prior art format for an automated gaming system.

FIG. 2 shows a top plan view of the same prior art automated gaming system 1 having a Virtual Group of users 212 with the viewing screen 7 shown more clearly as a CRT monitor. It can also be seen that each player position has to form an arc cut into the semicircular player seating area 18. FIG. 3 shows a side elevational view of the same prior art automated gaming system of FIGS. 1C and 2 where the orientation of the three different types of CRT monitors 7, 9 and 10 are shown.

Figure 4:
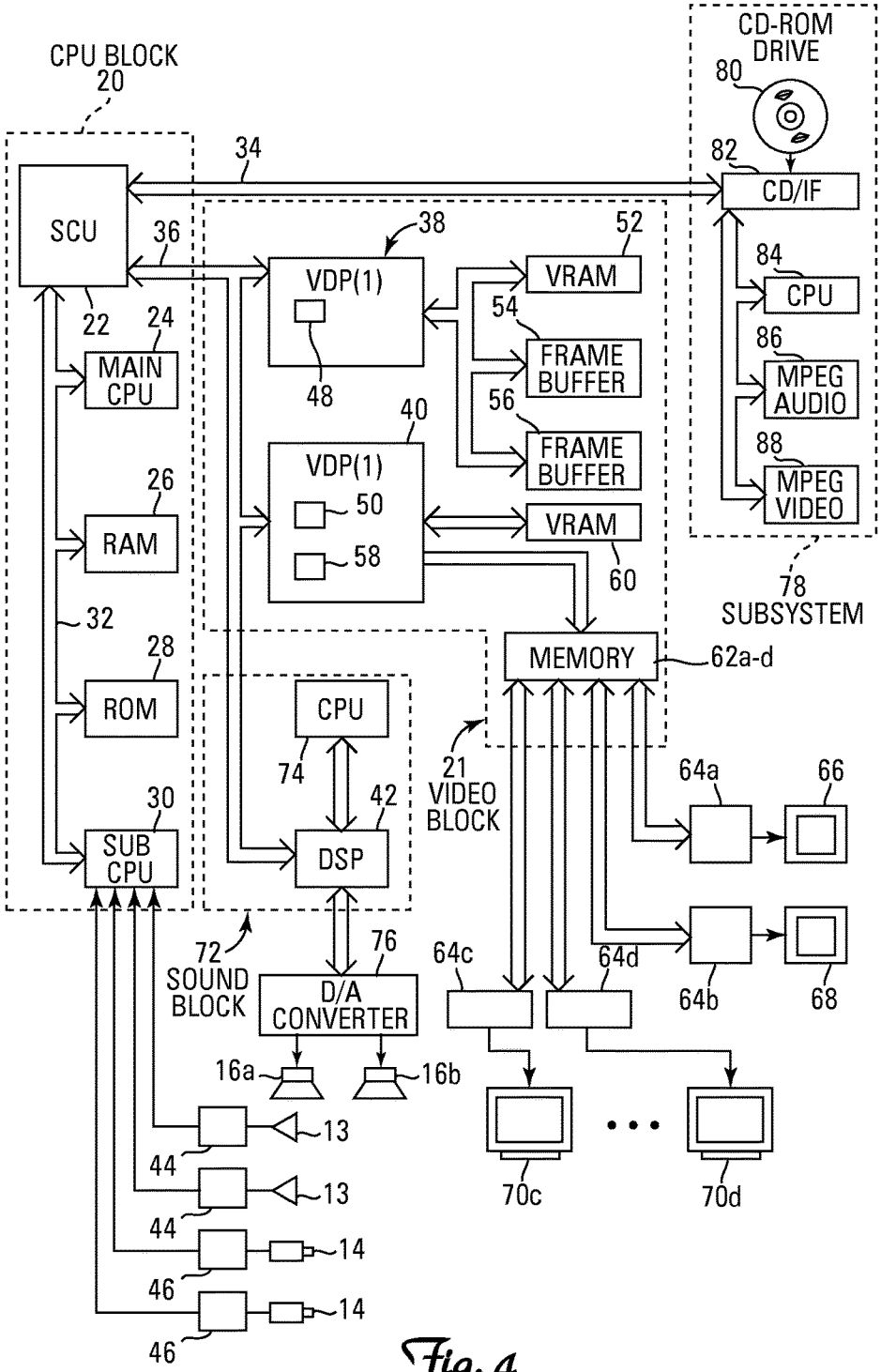
Fig. 4 Prior Art
FIG. 4 (PRIOR ART) shows a block schematic diagram of the electronic configuration of a prior art automated gaming system.
Figure 4A:
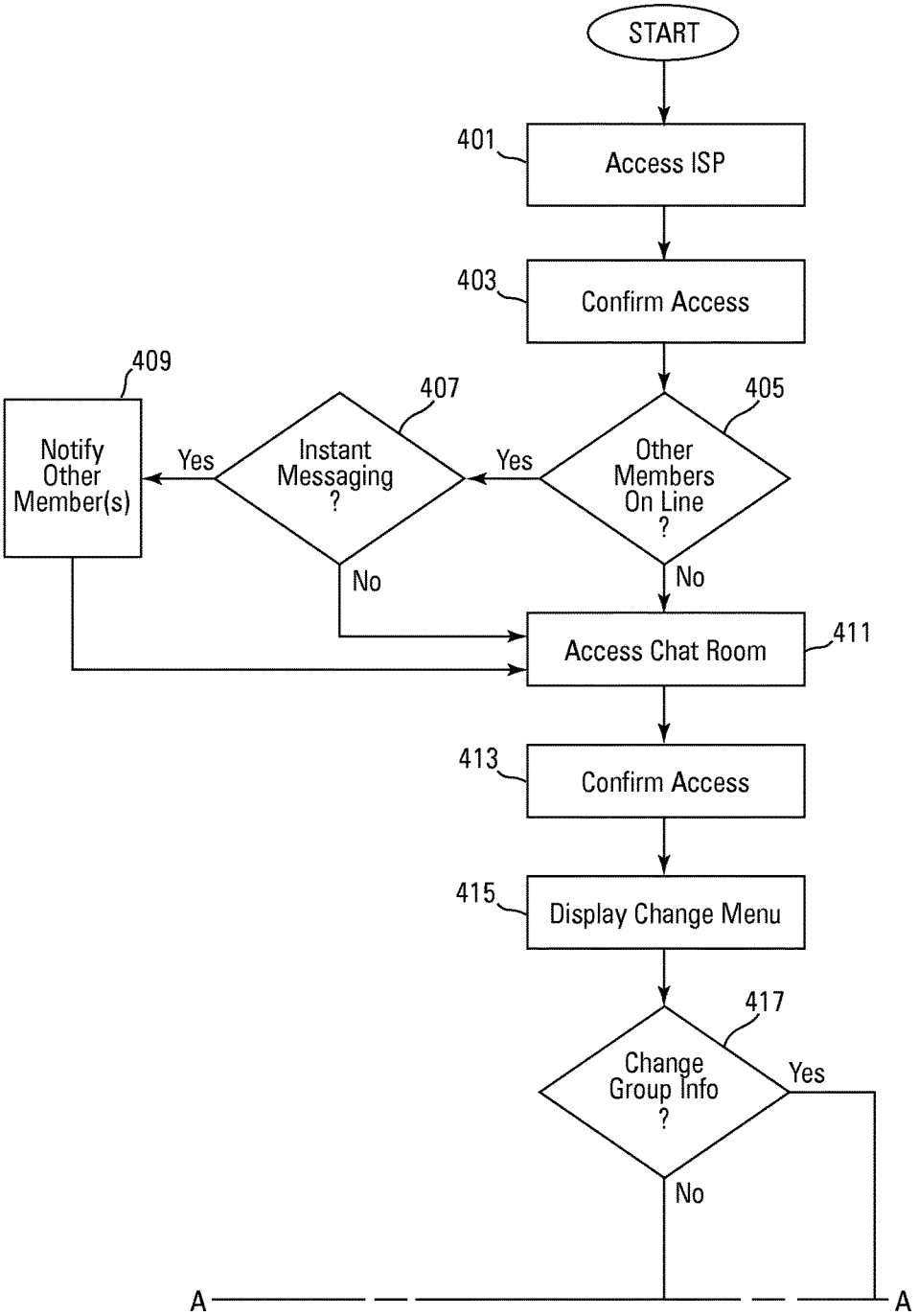
Fig. 4A Prior Art
FIG. 4A (PRIOR ART) shows a schematic for a Prior Art internet wagering system that may be used in combination with the present invention.
Figure 4B:
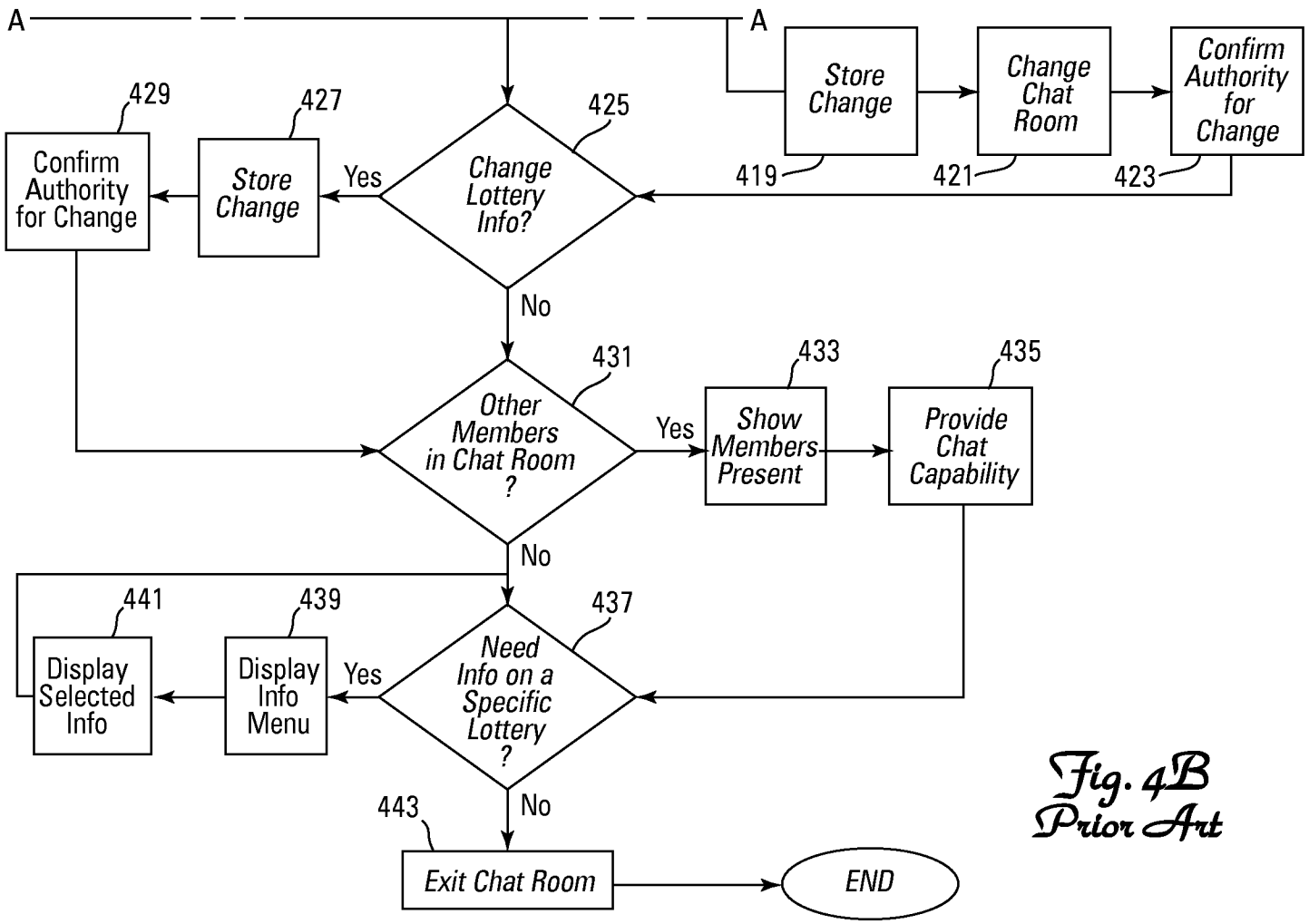
Fig. 4B Prior Art
FIG. 4B (PRIOR ART) shows a schematic for a Prior Art internet wagering system that may be used in combination with the present invention.

FIG. 4 shows the schematic circuitry of a prior art automated system as disclosed in U.S. Patent Publication No. 2003/0199316. FIG. 4 is a block diagram of processing circuitry in the game device of FIG. 1C. The game device housing comprises a CPU block 20 for controlling the whole device, a picture block 21 for controlling the game screen display, a sound block for producing effect sounds and the like, and a subsystem for reading out CD-ROM.

The CPU block 20 comprises an SCU (System Control Unit) 22, a main CPU 24, RAM 26, RAM 28, a sub-CPU 30, and a CPU bus 32. The main CPU 24 contains a math function similar to a DSP (Digital Signal Processing) so that application software can be executed rapidly.

The RAM 26 is used as the work area for the main CPU 24. The RAM 28 stores the initialization program used for the initialization process. The SCU 22 controls the busses 32, 34 and 36 so that data can be exchanged smoothly among the VDPs 38 and 40, the DSP 42, and other components.

The SCU 22 contains a DMA controller, allowing data (polygon data) for character(s) in the game to be transferred to the VRAM in the video picture block 21. This allows the game machine or other application software to be executed rapidly. The sub-CPU 30 is termed an SMPC (System Manager & Peripheral Control). Its functions include collecting sound recognition signals from the sound recognition circuit 44 or image recognition signals from the image recognition circuit 46 in response to requests from the main CPU 24. On the basis of sound recognition signals or image recognition signals provided by the sub-CPU 30, the main CPU 24 controls changes in the expression of the character(s) appearing on the game screen, or performs image control pertaining to game development, for example. The picture video block 21 comprises a first VPD (Video Display Processor) 38 for rendering TV game polygon data characters and polygon screens overlaid on the background image, and a second VDP 40 for rendering scrolling background screens, performing image synthesis of polygon image data and scrolling image data based on priority (image priority order), performing clipping, and the like. The first VPD 38 houses a system register 48, and is connected to the VRAM (DRAM) 52 and to two frame buffers 54 and 56. Data for rendering the polygons used to represent TV game characters and the like is sent to the first VPD 38 through the main CPU 24, and the rendering data written to the VRAM 52 is rendered in the form of 16- or 8-bit pixels to the rendering frame buffer 54 (or 56). The data in the rendered frame buffer 54 (or 56) is sent to the second VDP 40 during the display mode. In this way, buffers 54 and 56 are used as frame buffers, providing a double buffer design for switching between rendering and display for each individual frame. Regarding information for controlling rendering, the first VPD 38 controls rendering and display in accordance with the instructions established in the system register 48 of the first VPD 38 by the main CPU 24 via the SCU 22.

The second VDP 40 houses a register 50 and color RAM 58, and is connected to the VRAM 60. The second VDP 40 is connected via the bus 36 to the first VPD 38 and the SCU 22 and is connected to picture output terminals Voa through Vog through memories 62*a-d* and encoders 64*a-d*. The picture output terminals Voa through Vog are connected through cables to the main game displays 66, 68 and the satellite displays 70. Scrolling screen data for the second VDP 40 is defined in the VRAM 60 and the color RAM 58 by the CPU 24 through the SCU 22. Information for controlling image display is similarly defined in the second VDP 40. Data defined in the VRAM 60 is read out in accordance with the contents established in the register 50 by the second VDP 40, and serves as image data for the scrolling screens that portray the background for the character(s). Image data for each scrolling screen and image data of texture-mapped polygon data sent from the first VPD 38 is assigned display priority (priority) in accordance with the settings in the register 48, and the final image screen data is synthesized.

Where the display image data is in palette format, the second VDP 40 reads out the color data defined in the color RAM 58 in accordance with the values thereof, and produces the display color data. Color data is produced for each display 66 and 68 and for each satellite display 70. Where display image data is in RGB format, the display image data is used as-is as display color data. The display color data is temporarily stored in memories 62*a-d* and is then output to the encoders 64*a-d*. The encoders 64*a-d* produce picture signals by adding synchronizing signals to the image data, which is then sent via the picture output terminals Voa through Vog to the display 66, 68 and the satellite displays 70. In this way, the images required to conduct an interactive game are displayed on the screens of the display 66, 68 and the satellite displays 70.

The sound block 72 comprises a DSP 42 for performing sound synthesis using PCM format or FM format, and a CPU 74 for controlling the DSP 42. Sound data generated by the DSP 42 is converted into 2-channel sound signals by a D/A converter 76 and is then presented to audio output terminals Ao via an interface (not shown). These audio output terminals Ao are connected to the input terminals of an audio amplification circuit (not shown). Thus, the sound signals presented to the audio output terminals Ao are input to the audio amplification circuit (not shown). Sound signals amplified by the audio amplification circuit drive the speakers 16*a* and 16*b*.

The subsystem 78 comprises a CD-ROM drive 80, a CD-I/F 82, and CPU 84, an MPEG-AUDIO section 86, and an MPEG-PICTURE section 88. The subsystem 78 has the function of reading application software provided in the form of a CD-ROM and reproducing the animation. The CD-ROM drive 80 reads out data from CD-ROM. The CPU 84 controls the CD-ROM drive 80 and performs error correction on the data read out by it. Data read from the CD-ROM is sent via the CD-I/F 82, bus 34, and SCU 22 to the main CPU 24 that uses it as the application software. The MPEG-AUDIO section 86 and the MPEG-VIDEO section 88 are used to expand data that has been compressed in MPEG (Motion Picture Expert Group) format. By using the MPEG-AUDIO section 86 and the MPEG-VIDEO section 88 to expand data that has been compressed in MPEG format, it is possible to reproduce motion picture. It should be noted herein that there are distinct processors for the CPU block, video block, sound block, CD-ROM drive and Memory with their independent CPU's. This requires significant computing power and still has dumb (no intelligence) player input components.

Figure 5:
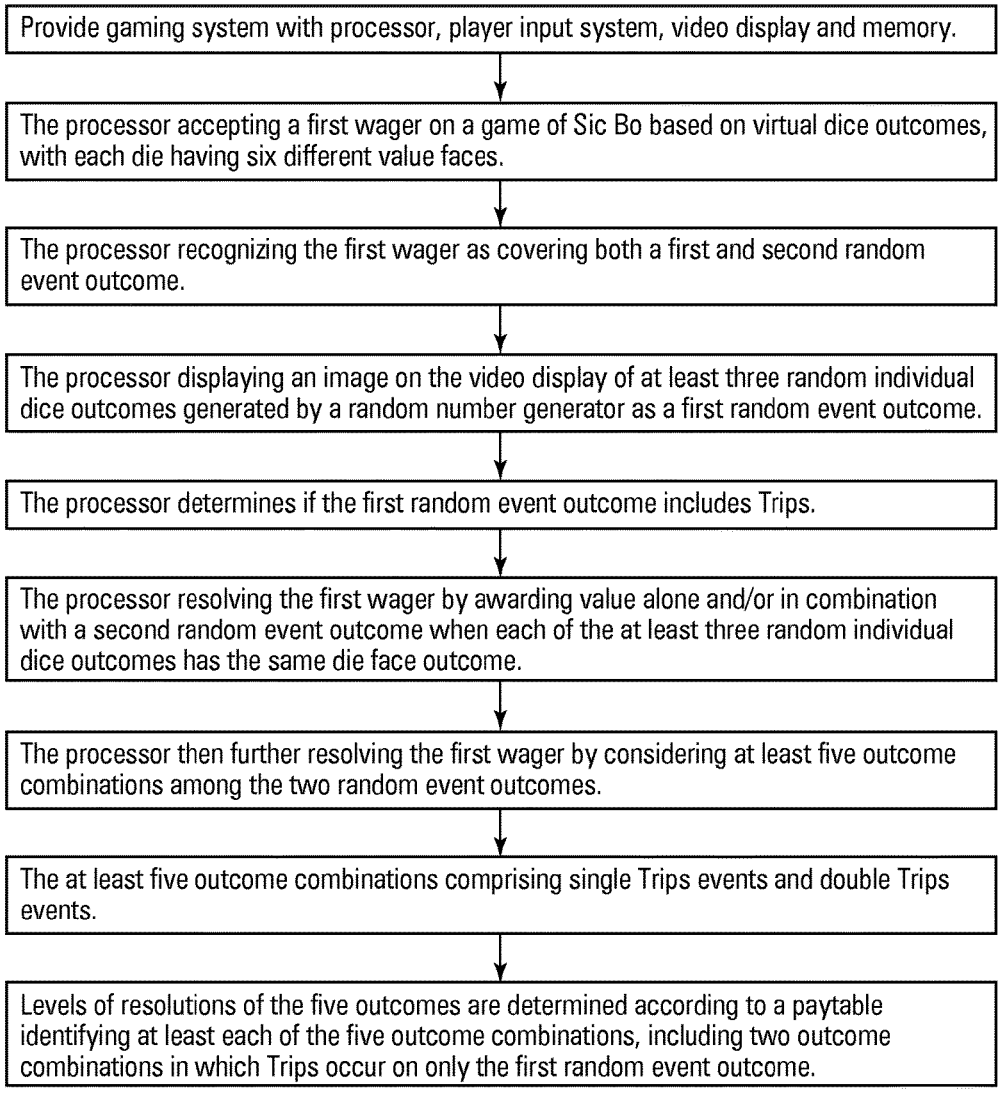
FIG. 5 shows a flow diagram for playing a wagering method according to the present invention.

FIG. 5 shows another example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The dealer screen 107 displays a virtual dealer, the dealer responding to instructions from the players. The player bank arrangement 103 has a common display screen 109 on which images of cards being dealt 105, dealer's cards 108, player cards 109, bets wagered (not shown) and also includes touch screen with or without electromechanical player input functions. The display 110 at each player station can also display information such as the composition of the player's hand, the credits wagered, historical win/loss information, pay tables and the like. Other player input functions may be provided on a panel 106 which might accept currency, coins, tokens, identification cards, player tracking cards, ticket in/ticket out acceptance, and the like.

Figure 6:
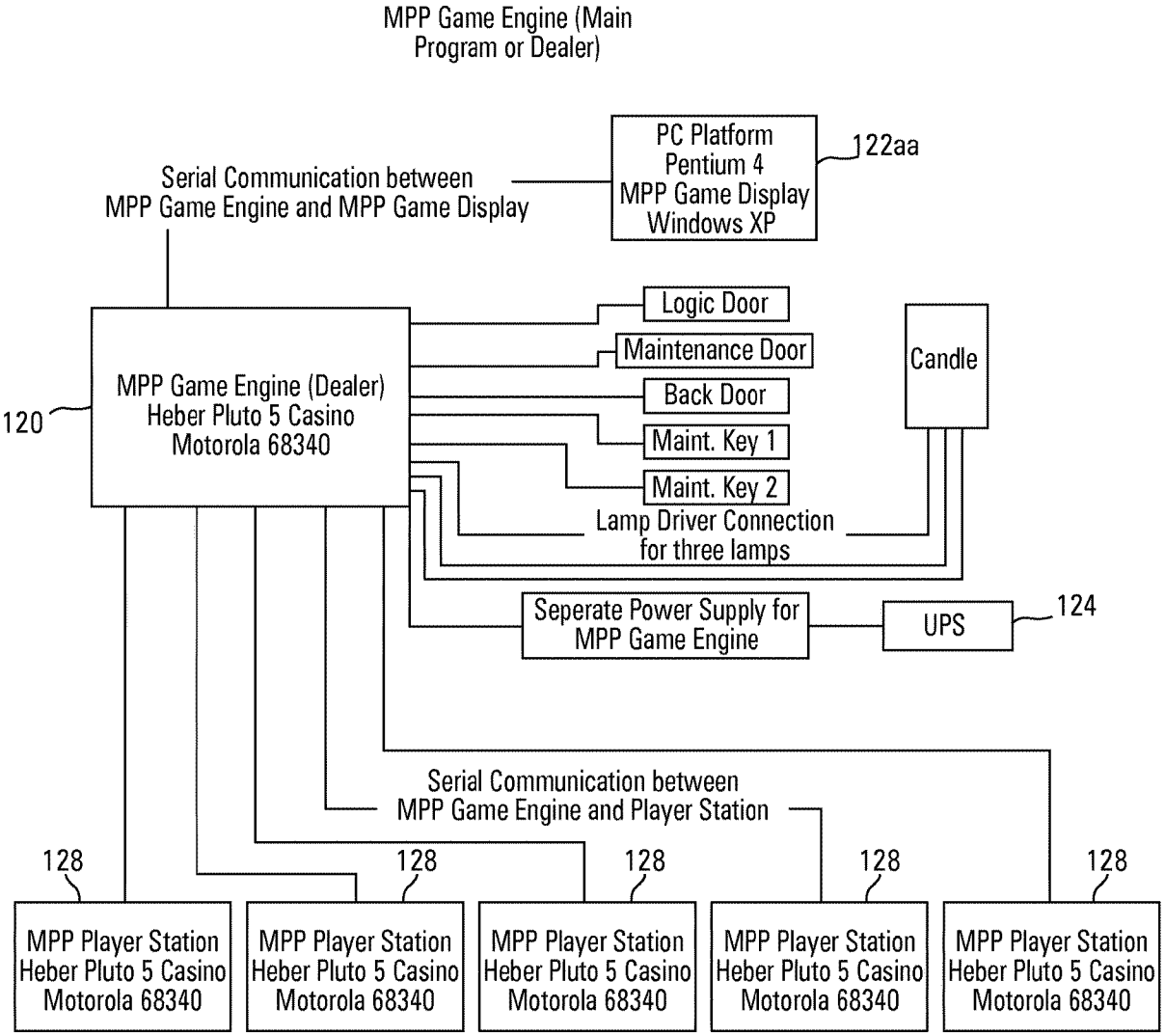
Fig. 6 Prior Art
FIG. 6 (PRIOR ART) shows a schematic diagram of a gaming engine useful in the practice of the present invention.

FIG. 6 (PRIOR ART) shows an electronic/processor schematic for a MultiPlayer Platform (MPP) gaming system according to the presently described invention. The MPP Game engine (dealer) comprises a Heber Pluto 5 casino game board 120 (Motorola 68340 board) operating off the PC Platform Pentium®4 MPP Game Display processor 122*aa*. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 124. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
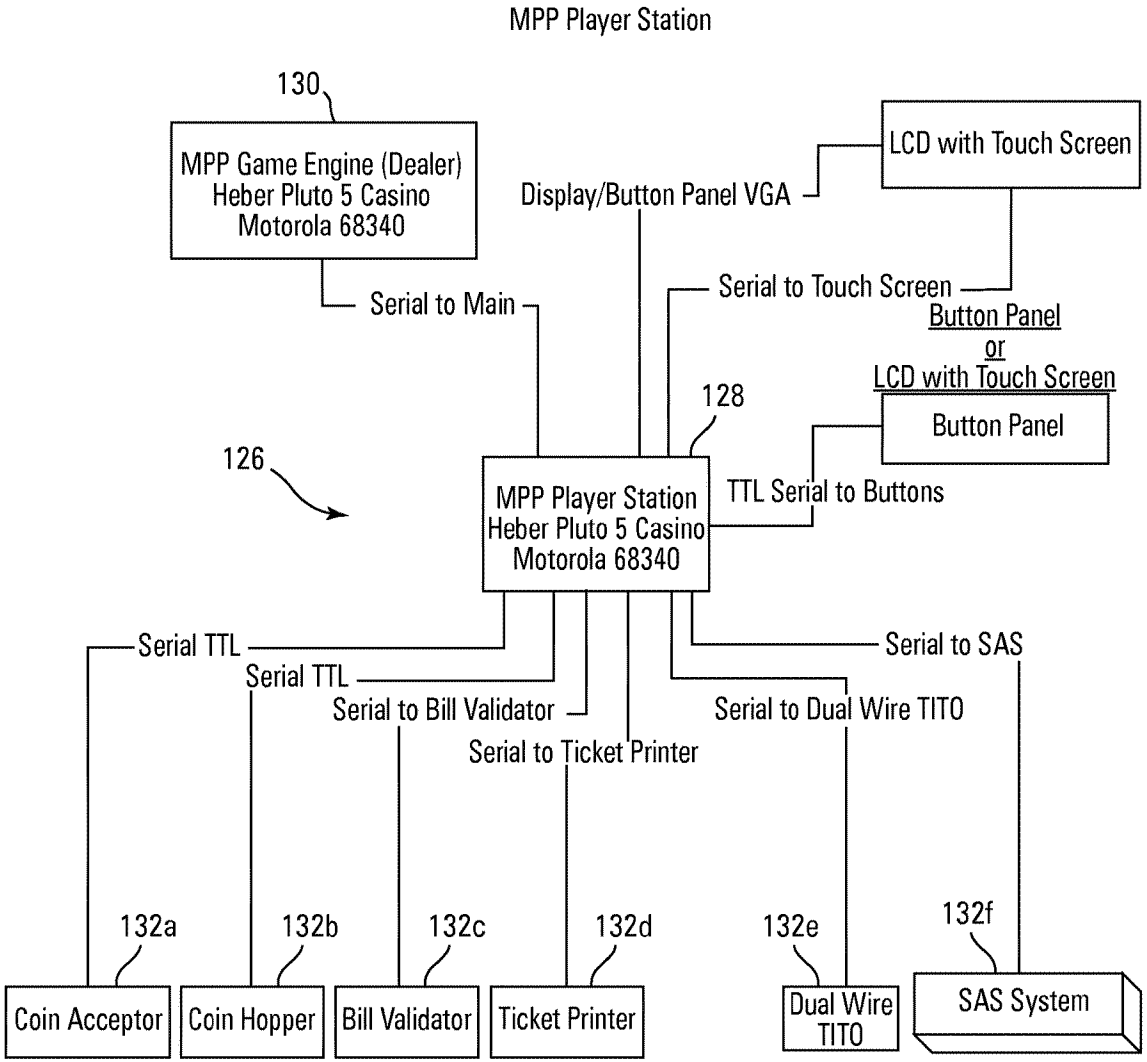
Fig. 7 Prior Art
FIG. 7 (PRIOR ART) shows a schematic diagram of a player station useful in the practice of the present invention.

FIG. 7 shows the electronic/processing schematics 126 of the MPP Player Station Intelligence board 128 (Heber Pluto 5 Casino, Motorola 68340), each of which player stations (one for each player position) is in direct connection to the MPP Game Engine 130 (Dealer), which is in turn directly connected to the PC Platform (not shown in this Figure). Each Intelligence board receives information for all player input systems 132*a-f* specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligent boards 128 at each player position being in direct communication with the MPP Game Engine 130, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
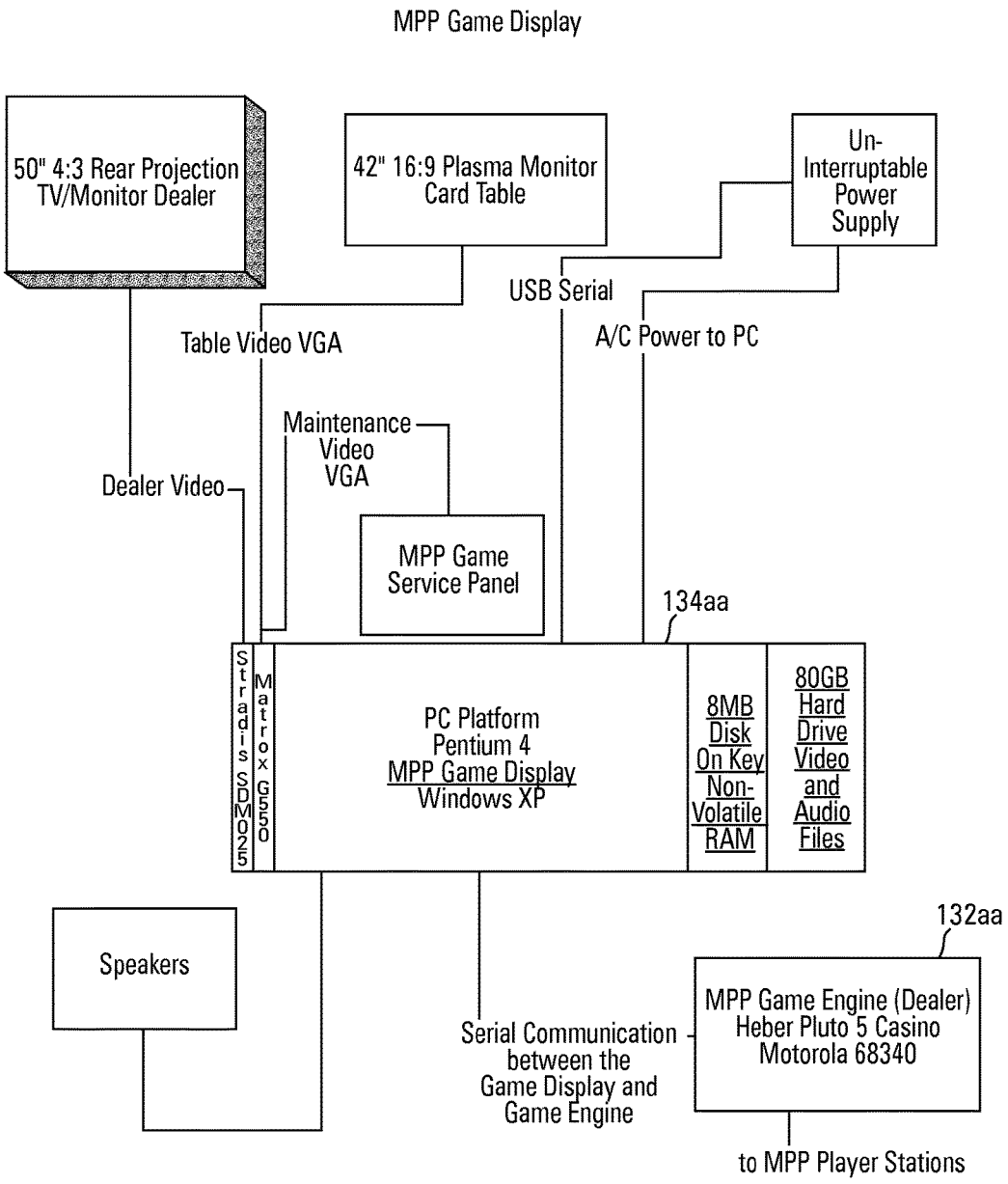
Fig. 8 Prior Art
FIG. 8 (PRIOR ART) shows a schematic diagram of a game display useful in the practice of the present invention.

An alternative system is shown in FIG. 8, where there is a dealer engine processor 132 intermediate the main game PC 134*aa* and the Player intelligent boards (not shown). Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 134*aa* is preferably a Pentium® 4 PC and is separate from the main processor 132. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 132) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside.

RS485 Board

RS485 is an industrial-grade board for linking multiple systems in unforgiving circumstances for centralized information gathering. The Heber RS485 board is fully optically-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013; www.heber.co.uk). Specifications for the various boards are identified below.

RS485 Interface

Host Interface

RS232 connection to Pluto 5/Pluto 5 Casino All power provided via RS232 link from host system Communication Port Dual four-way Molex 0.1" KK headers for daisy chaining purposes Dimensions 80.times.61 mm (3.14×2.4") Part Number Opto-isolated RS485 board 01-14536-2 HII/ccTalk Interface Host Interface RS232 connection to Pluto 5/Pluto 5 Casino All power provided via RS232 link from host system Communication Port Single or dual 10 way header connectors Dimensions 101.6.times.69.85 mm (4.times.2.8") Part Number Dual channel HII/ccTalk board 01-16171-2 Four Channel Relay Board Host Interface Connection to Pluto 5/Pluto 5 Casino via ribbon cable using four standard output lines All power provided via ribbon cable link from host system Switching Capabilities Up to 250V AC or DC@7 A maximum per channel Dimensions 80.times.61 mm (3.14.times.2.4") Part Number Four channel relay board 01-15275-1 80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Technical Description and Benefits of Electronic Die Gaming

It creates the ability to track performance of side bet (drop and win).

There are unlimited virtual betting circles for the underlying games and the side bet. Since it is possible to have multiple side bets active at any given time (see description above). The player will then be prompted to select a "lucky trips." As many as 6 sets of 3 dice will appear (each one representing one of the 6 possible triples (1-6). The player will then be prompted to select a wager amount and in a preferred embodiment, select among colors available among the dice color available, as further explained herein. He then can select another "lucky trips" (in which case the player will be asked the wager amount again) or he can close "X" out the betting circle.

Rules and pay tables will also be displayed to the right of the main big betting circle. After each roll of the dice, the betting positions to the right will resolve the wager (because this is the $2^{nd}$ and final roll of the dice for that wager) . . . "WINNER" and the payout will appear if there were any winning wagers, and then this circle will become the big circle to the left for new wagers. The betting positions or betting circles always retain their color when they move positions. After this circle becomes the new big circle, the other colored betting circle (for the game in progress) slides to the right. For the each wagering event which already has 1 'roll of the dice' result, the result will appear in the middle of the betting circle.

If the player touches any particular betting position, the video display (touch screen) and processor will appear in larger format and display the current roll of the dice result and show his wager selections.

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth™, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on the Intel® Pentium® or Centrino™ processor, that are adapted to communicate with the computer. Any number and type of devices may be in communication with the computer.

In some embodiments, a server computer and one or more client computers may perform desired actions. Actions may be performed by one or more of the clients and/or servers in accordance with a desired distribution of labor. Such distribution of labor may be made based on where the actions may be performed more securely, more quickly, and/or more cost-effectively. For example, in some implementations, complex calculations may be performed by a central server to increase speed, display related calculations may be performed by a client because they may be simple, outcome determining calculations may be performed by a central server in order to ensure the validity of the calculations and allow tweaking of odds to be performed at a single location. It should be recognized that any desired actions may be divided among a server and any number of clients in any desired way.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human). In one embodiment, the gaming device preferably includes at least one processor, such as a microprocessor, a microcontroller-based platform, a suitable integrated circuit or one or more application-specific integrated circuits (ASIC's). The processor is in communication with or operable to access or to exchange signals with at least one data storage or memory device. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The upper display device may display the primary game, any suitable secondary game associated or not associated with the primary game and/or information relating to the primary or secondary game. These display devices may also serve as digital glass operable to advertise games or other aspects of the gaming establishment. As seen in FIG. 1A, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device. The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, the display device includes a touch-screen with an associated touch-screen controller. The display devices may be of any suitable size and configuration, such as a square, a rectangle or an elongated rectangle.

The general scope of the invention may include methods and systems as follows. A method of playing a wagering game on an electronic gaming system may have, for example:

a) a central processor;
b) a video display system;
c) data entry systems in communication with the central processor;

d) an electronic random number generator in communication with the central processor; and e) memory containing look-up tables of event result tables;

The two virtual dice have six virtual faces and each virtual face has a number indicator of only one of 1, 2, 3, 4, 5 or six thereon, and each of the six virtual faces has a different number indicator thereon, and the third virtual die has six virtual faces and each virtual face has a number indicator of only one of 1, 2, 3, 4, 5 or six thereon, and each of the six virtual faces has a different number indicator thereon. A virtual game field surface is displayed on the video display system and is used to display movement of a game piece a virtual amount related to the numeric total of the two virtual dice and the paytable associated to the numeric result by a random outcome on the third virtual die according to rules of play of the game stored in the memory. The virtual game field surface may have markings and words relating the wagering game to a sporting event, such as for soccer or where the sporting event is American Football. The event outcome table is separate from the paytable and the event outcome table identifies at least touchdowns, distance of ball movement and penalties according to the combination of numerical result from the two virtual dice and the specific results associated with displayed symbology on the third virtual die. The method may be played wherein after a touchdown occurs in the wagering game, at least one virtual die is recast to determine if an extra point wagering event is achieved. The proposition wagers, if any, are recognized by the processor from the data entry system, the proposition wager being on at least one proposition wager event determined by the virtual casting of the three virtual dice selected from the group consisting of a) a one-roll touchdown; b) a one-roll turnover; c) a one roll penalty; and d) a one roll specific yardage result.

The event outcome is determined by the processor executing code to compare the virtual gaming event outcome from the virtual casting of the virtual three dice and the event results table. The proposition wagers may be recognized as being on at least one proposition wager event determined by the casting of the three virtual dice selected from the group consisting of the side bet wagers on trips or other events. The processor displays at least one of the event result tables on the video display system and indicates virtual game outcomes for the dice results, and in the variant with two or more colors, the possible event outcomes on wagers using non-selected colors may also be displayed. The processor compares and may cause to be displayed the random event of the virtual casting of the three virtual dice with the event result tables or paytables to determine wagering or game events from the random event. The data entry systems are selected from the group consisting of hand-held wireless communication devices, networked television systems, keypads, stand-alone wagering terminals, personal computers on a network or internet and banks of wagering terminals.

A gaming system for playing the wagering game may have, as described in greater detail above:

a) a central processor;

b) a video display system;

c) data entry systems in communication with the central processor;

d) an electronic random number generator in communication with the central processor; and e) memory containing look-up tables of event result tables.

The video display system displays an image of both a virtual game gaming table upper surface with virtual indicia thereon indicating event outcomes, odds and payouts;

the virtual dice being displayed on the virtual display system at a position on the virtual upper surface; an event result tables or paytables having a plurality of outcomes arranged in rows and columns; and the video display system displays (at least) three virtual dice, the three virtual dice may comprise three identical dice or two identical virtual dice and a third virtual die that is visually distinguishable from the two virtual dice for providing a visual appearance that is distinct from the visual appearance of the first two virtual dice. Events may be defined in the look-up tables or paytables to determine an outcome of that numeric result from the first two dice or three dice in event result tables or paytables.

The two virtual dice of each color or the same color may have six virtual faces and each virtual face has a number indicator of only one of 1, 2, 3, 4, 5 or six thereon, and each of the six virtual faces has a different number indicator thereon. However, as the dice are virtual and are not limited by the physics of real space, 5-faced die, 7-faced die, 8-face die and the like may be used in the variable world, with more potential outcomes therefore being available.

The present gaming technology may also be practiced with variations of technology available internet gaming. Apparatus and methods described in Published U.S. Patent Application Documents Nos. 20120089921; 20110082571; 20100234110; 20090036186; 20080201227; 20080033734; 20070162563; 20040249707; 20040067794; 20030224856; 20030032480; 20020082085, which are incorporated herein in their entirety to support and enable internet wagering on the present invention.

FIG. 1 is a diagram that illustrates an Internet gaming system according to the invention in general. The system according to the invention comprises at least one server (e.g., servers 101, 102 . . . ) and at least one computer (e.g., computers 111, 112 . . . ) connected to the at least one server over the Internet, e.g., using an Internet service provider such as America Online™ (AOL™) or Prodigy™. An Internet service provider or ISP is a service, commercial or otherwise, that provides access to the Internet for end users. The servers 101, 102 . . . are connected to the Internet via connections (e.g., connections 121, 122 . . . ) respectively) such as a modem line, a T1 line or any variant of digital subscriber line (DSL) including ADSL (advanced digital subscriber line). The computers 111, 112 . . . are connected to the Internet via connections (e.g., connections 131, 132 . . . , respectively) such as a modem line, a T1 line or any variant of digital subscriber line (DSL) including ADSL (advanced digital subscriber line). Purchasers of wagers or entry into the gaming system, as end users at one of the computers can access a server over the Internet using the service provided by the ISP.

The servers (101, 102 . . . ) can send information to the purchasers of lottery tickets by communicating with the computers (111, 112 . . . ) over the Internet (e.g., via connections 121, 122 . . . and 131, 132 . . . , respectively), the at least one telephone (e.g., tel 143, 144 . . . ) over landline 134, the at least one fax (e.g., fax 145, 146 . . . ) over landline 135, or the at least one cellular telephone (e.g., 147, 148 . . . ) over the airwaves or via satellite by using transmitter 141 provided therefor. If a group of players desires to place wagers in bulk, a virtual group may be created therefor at a server which includes corresponding information with respect to the group of purchasers (group information) and the placing of wagers.

Systems used may also operate as a system in which the remote gaming system provides remote access to a legal gaming system. In one example, the participant may be located at a distant city, The player may be accessing the game using his personal communication system, tablet, Pad, processor, PC etc. The participant will access a game server at a remote location. The game server may be on an Indian reservation, wherein gaming is authorized and legal. The game system will include a database which will include critical information of the participant, assuring that he is authorized to operate the game. For example, the participant will provide critical personal information such as personal ID and the location of the terminal or, as shown, the user communication system or terminal (e.g., PC).

The location of the terminal is a critical component of the invention. In most jurisdictions where gaming is legal, it is not legal to cross state lines. So in almost all cases, even where remote access is permitted, the game operator and the participant must be in the same state. Therefore, the game operator must have assurances that the accessing terminal is in the same state as the game server or over federally authorized gaming services and/or providers.

When a terminal is permanently installed, the location is known. When a portable device is used, such as a PDA, cell phone, laptop or the like, the position is not known unless a positioning signal is sent to the game server. In those instances where a portable terminal is used, or even where a permanently installed terminal may be routinely moved, the terminal may be be required to have a GPS signal generator which can be received by the game server to assure the location of the participant.

The GPS signal generator would he associated with any device which has the capability of being moved to a new location which may be outside the authorized jurisdiction, for example, a PDA, a cell phone, as well as the user PC. The GPS signal generator may not be required in a permanently installed kiosk.

In use of any of the terminals, the participant accesses the game server via the Internet. The critical m information for the participant is maintained in the database. This confirms that the participant is an authorized participant and that he is in an authorized location.

In one embodiment of the invention a biometric sensor will be associated with each remote terminal which can be used by the participant to access the game sever. This provides even more detailed information assuring authenticity of the participant.

Typically, the server will request the biometric information at the outset of a session and for each transaction, or at the minimum, on a random basis. It may be desirable to shut down the terminal for a specified period of time (lock it out from the game server) in the event an unauthorized participant is detected. The game operator may have a banking capability at the authorized gaming location. In this case, the bank server would have the capability to transact electronic banking functions with the game server without violating any wire or banking laws and regulations. The participant may have an account at the bank associated with server. He will place funds in this account. When he participates in gaming from a remote location, he will have preauthorized the game sever to electronically withdraw or deposit funds into his account via the banking sever. The participant is not involved in these transactions. He may access his account via the banking server in normal fashion and may deposit or withdraw funds. However, the participant cannot communicate with the game server about financial transactions. For example, in the event the participant becomes overdrawn, the resolution of that is between him and the bank. The game operator is not involved.

Similarly with the third (or more) virtual die, there may be five, six, seven or eight (for example) virtual faces and each virtual face has a number indicator of only one of 1, 2, 3, 4, 5 or six thereon (or other numbers or symbols), and each of the (for example) six virtual faces has a different number indicator thereon.

Game Math and Hold Description

Lucky Trips Side Bet

| Event for 2 rolls | Ways | p | EV | p*EV |
|---|---|---|---|---|
| Lucky trips 2x | 1 | 0.00002143 | 1000 | 0.021433 |
| Lucky Trips 1x/ Any Trips 1x | 10 | 0.00021433 | 500 | 0.107167 |
| Any Trips 2x | 25 | 0.00053584 | 100 | 0.053584 |
| Lucky Trips 1x | 420 | 0.00900206 | 25 | 0.225051 |
| Any Trips 1x | 2,100 | 0.04501029 | 10 | 0.450103 |
| Nothing | 44,100 | 0.94521605 | −1 | (0.945216) |
| Total: | 46,656 | 1.00000000 | EDGE: | (0.087877) |

With respect to events where the three outcome virtual images of facial displays on the dice are the same, the table can be presented as follows, where the term "Trips" refers to three same virtual images on die faces, and a "Specific Trip Outcome" refers to a wager on a single facial outcome, e.g., only one of 1, 2, 3, 4, 5 or 6 (wagering, for example, on Trips of 3's only as the "Lucky Trip":

| Event for 2 Random Event Outcomes | Ways | Probability | Payout versus First wager | Probability of the Payout on the First Wager |
|---|---|---|---|---|
| Two Identical Trips | 1 | 0.00002143 | 1000 | 0.021433 |
| Two Trips Outcome with a Specific Die Outcome Wagered | 10 | 0.00021433 | 500 | 0.107167 |
| Any 2 Trips Outcomes | 25 | 0.0053584 | 100 | 0.53584 |
| Specific Trip Outcome Wagered | 420 | 0.00900206 | 25 | 0.225051 |
| Any Trips | 2100 | 0.04501029 | 10 | 0.4501029 |
| No Trips | 44,100 | 0.94521605 | −1 | −0.94521605 |
| TOTAL | 46,656 | 1.00000000 | EDGE | 0.087877 |

The house edge can be easily adjusted by altering the payouts. Progressive wagers can be easily adopted for Lucky Trips 2× or more. Only Highest Win Pays and maximum payout should be set at the casino.

The present technology, although emphasis in the disclosure has been on virtual gaming systems where there are no physical dice, can be played in a number of variations using physical dice, either on a traditional gaming table with physical dice and physical placement of wagers, a newer gaming table with physical dice and electronic wagering on player input terminals associated with the gaming table, or on an automatic dice tumbler (with enclosed dice 'tossed' by a 'popper' to produce random results) with electronic wagering on player input terminals associated with the mechanical automatic dice tumbler. Such systems may be described as a method of playing a wagering game on a gaming system that comprises a gaming table, more than X physical dice (preferably where X is at least three), and a wagering display pattern on the gaming table (or on an electronic wagering input terminal or other data entry device in ultimate or direct communication with a processor and game controller, the method having steps that may include:

a first wager is positioned on the wagering display pattern on a game having a wager based upon physical dice outcomes for exactly X physical dice, wherein a visual characteristic for one of the X dice is identified by the wager positioned on the wagering display pattern;

upon the more than X physical dice providing a first random event outcome that comprises a result from at least X individual physical die outcomes wherein at least two of the more than X physical dice have visual characteristics that differentiate between an at least two other individual virtual dice from the more than X physical dice;

i) the physical dice outcomes comprising a physical dice event result of greater than X individual physical die outcomes, including the visual characteristics that differentiate between the at least two other individual virtual dice;

ii) the physical dice outcome determining a random game event outcome for resolution of a game event outcome by using only X virtual dice in determining the game event outcome where 1) a specific selected visual characteristic of at least one of the at least two of the individual physical dice which have visual characteristics that differentiate between the at least other two individual physical dice or 2) using only non-excluded specific visual characteristics of at least one of the at least two of the individual die which have visual characteristics that differentiate between the other at least two individual dice;

resolving the first wager by awarding value according to a paytable when the X virtual dice provide a predetermined winning outcome according to a comparison of the game outcome to the paytable. The awarding can be done fully electronically if wagers are placed electronically, or by a courpier, which is where simplification of the variations in colors and numbers of dice, as later enumerated, would be preferred. The dice may be one set or two sets of pairs of dice, any pair having a unique color, and two sets of single die, each single die having a unique color not only from the other single die, but also from each of the pairs of dice. This use of dice would be most easily read by a roupier and/or electronic reading system, and in determining the game outcome, excluding consideration of all of the greater than X die that have either excluded visual characteristics or non-selected visual characteristics according to the steps (individually or collectively, above) and for example the first paragraph and i) and ii). For example, with two pairs of dice (one red, one yellow) and one individual die (green), the initial wager may be on red (two dice) and green (one die) for a final outcome, or on yellow (two dice) and green (one die) according to standard Sic Bo rules, or on both combinations as two separate wagers. In another example, with two pairs of dice (one red, one yellow) and two individual die (green and blue), the initial wager may be on red (two dice) and green (one die) for a final outcome, or on yellow (two dice) and green (one die), red (two dice) and blue (one die) for a final outcome, or on yellow (two dice) and blue (one die), according to standard Sic Bo rules, or on all four combinations as four separate Sic Bo wagers.

The visual characteristic(s) may be color of the virtual dice (die) and the acceptance of the wager requires identifying an at least one color that is selected in step a) (the first paragraph describing the method) for determination of a winning game event outcome or at least one color that is excluded for determination of a winning game event outcome. For example, the reading of outcomes by a dealer/croupier (and even the processor with die outcome reading technology (as described above and as known in the art) and processor should be simplified to reduce the potential for error.

The winning event outcomes are determined according to outcomes for exactly three physical dice, and for example, exactly four physical dice, exactly five physical dice, or exactly 6 physical dice (or more combinations) are displayed in game event outcomes on the gaming table.

The winning event outcomes may be determined according to outcomes for exactly three physical dice and at least four physical dice that are displayed in game event outcomes on the gaming table.

The winning event outcomes may be determined according to outcomes for exactly three physical dice and at least five physical dice that are displayed in game event outcomes on the gaming table.

The winning event outcomes may be determined according to outcomes for exactly three virtual dice when as many as exactly six physical dice or more are displayed in game event outcomes on the gaming table. By increasing the numbers of pairs and individual die, more wagering options on a physical (or virtual) game event outcome can be created.

The game can be played with each individual die having a unique color, with as many dice as desired, but the ability of players to visually differentiate among greater numbers and smaller differences in colors would complicate the game. In such a system, players could bet on any three color combinations such as yellow, gold and tan, while an orange, brown, and red die were present, among which the player might have difficulty in quickly resolving the outcome.

The present technology may also be used in combination with hologram technology which is the subject matter of U.S. patent application Ser. No. 13/631,195 filed 28 Sep. 2012, which is incorporated herein by reference. Any format, system or apparatus that can be used to provide the processor, video display system, player input system, game rules, communication links and memory can be modified by one skilled in the art and adapted top play of the present technology.

What is claimed:

1. A method of playing a wagering game on a gaming system that comprises a processor, a random number generator, game logic, an acceptor configured to receive a physical item associated with monetary value to establish a credit balance for a player, a video display, a cashout device configured to enable credits to be cashed out from the credit balance, and a player input system comprising at least one of a button input panel and a touchscreen input, the method comprising:

a) the processor accepting a first wager from entry of the first wager through the player input system on a wagering game of Sic Bo in which three virtual dice are provided on the video display by the processor, the wager based upon virtual dice outcomes and deducted from the credit balance;

b) the first wager overlapping two consecutive random event outcomes comprising a first random event outcome displayed as a first set of three virtual dice provided on the display screen by the processor and the random number generator and a second random event outcome displayed as a second set of three virtual dice displayed on the display screen by the processor and the random number generator, the processor providing the first random outcome that comprises at least three individual virtual die outcomes;

c) the processor displaying an image on the video display that includes a virtual image of the three individual die outcomes;

d) the processor determining that the first random outcome includes three virtual dice each having a same die face outcome;

e) the processor resolving the first wager by awarding value monitored by the gaming system when the three virtual dice each has the same die face outcome and increasing the credit balance in association with any awarded value;

f) the processor always maintaining active consideration of the first wager with respect to a random outcome of the second random event outcome displayed as a second set of three virtual dice displayed on the display screen by the process; and g) the processor, in response to activation of the cashout device, enabling credits to be cashed out from the credit balance and provided to the player.

2. The method of claim 1 wherein each of the at least three individual virtual dice has six faces with different numerical values displayed on each face.

3. The method of claim 2 wherein the first random event outcome is provided by an electronic random number generator and multiple side bets have been received by the processor from a single player input position and each individual ones of the multiple side bets are dependent upon separate virtual dice sets of exactly three dice in each separate dice set displayed on the video display, and the processor resolves each one of the multiple side best based upon occurrence of the three specific dice having an identical number with respect to a specific one of the separate virtual dice sets for each one of the multiple side bets, and at least two and no more than six separate dice sets are displayed on the video display.

4. The method of claim 1 wherein each of the at least three individual virtual dice has six faces with different art work displayed on each face.

5. The method of claim 1 wherein the first wager carries over into the second random event outcome when the processor has determined that the first random event outcome includes three virtual dice each having a same die outcome, and that the processor further resolves the first wager by awarding value monitored by the gaming system when the three virtual dice each has another same die outcome after the second random event outcome and there are multiple player input stations in communication with the processor, and each of the multiple player stations independently places at least one wager of the virtual dice outcomes.

6. The method of claim 5 wherein the first random event outcome and the second random event outcome are provided by an electronic random number generator and multiple side bets have been received by the processor from a single player input position and each individual ones of the multiple side bets are dependent upon separate virtual dice sets of exactly three dice in each separate dice set displayed on the video display, and the processor resolves each one of the multiple side best based upon occurrence of the three specific dice having an identical number with respect t to a specific one of the separate virtual dice sets for each one of the multiple side bets, and at least two and no more than six separate dice sets are displayed on the video display.

7. The method of claim 5 wherein the first wager carries over into a second random outcome when the processor has determined that the random outcome includes three virtual dice each having a same die outcome, and that the processor further resolves the first wager by awarding value monitored by the gaming system when the three virtual dice each has another same die outcome after the second random event.

8. The method of claim 5 wherein the first wager is resolved by the processor based upon a look-up table in which both the first random event outcome and the second random event outcome are considered in the resolution of the first wager according to the following:

| Event for 2 Random Event Outcomes | Ways | Probability | Payout versus First wager | Probability of the Payout on the First Wager |
|---|---|---|---|---|
| Two Identical Trips | 1 | 0.00002143 | 1000 | 0.021433 |
| Two Trips Outcome with a Specific Die Outcome Wagered | 10 | 0.00021433 | 500 | 0.107167 |
| Any 2 Trips Outcomes | 25 | 0.0053584 | 100 | 0.53584 |
| Specific Trip Outcome Wagered | 420 | 0.00900206 | 25 | 0.225051 |
| Any Trips | 2100 | 0.04501029 | 10 | 0.4501029 |
| No Trips | 44,100 | 0.94521605 | −1 | −0.94521605 |
| TOTAL | 46,656 | 1.00000000 | EDGE | 0.087877 |

9. The method of claim 8 wherein the processor receives and resolves electronic wagers from the player input system.

10. The method of claim 1 wherein the first random event outcome is provided by an electronic random number generator and multiple side bets have been received by the processor from a single player input position and each individual ones of the multiple side bets are dependent upon separate virtual dice sets of exactly three dice in each virtual dice set displayed on the video display, and the processor resolves each one of the multiple side best based upon a specific one of the separate virtual dice sets for each one of the multiple side bets.

11. The method of claim 1 wherein at least two dice have a visual characteristic of a color that is different from a visual characteristic of color of a third die and the acceptance of the wager requires input identifying at least one color that is selected for determination of a winning game event outcome or at least one color that is excluded for determination of a winning game event outcome.

12. The method of claim 11 wherein winning event outcomes are determined according to outcomes for exactly two virtual dice and at least three virtual dice are displayed in game event outcomes on the video display system.

13. The method of claim 11 wherein winning event outcomes are determined according to outcomes for exactly three virtual dice and at least four virtual dice are displayed in game event outcomes on the video display system.

14. The method of claim 11 wherein winning event outcomes are determined according to outcomes for exactly three virtual dice and at least five virtual dice are displayed in game event outcomes on the video display system.

15. The method of claim 11 wherein winning event outcomes are determined according to outcomes for exactly three virtual dice and at least six virtual dice are displayed in game event outcomes on the video display system.

16. The method of claim 1 wherein a processor receives and resolves electronic wagers from the player input system.

* * * * *